US011700962B2

(12) United States Patent
Ruth et al.

(10) Patent No.: US 11,700,962 B2
(45) Date of Patent: Jul. 18, 2023

(54) MOUNTABLE BRACKET WITH MULTIPLE MOUNTING RAILS

(71) Applicant: MOTOGO, LLC, Austin, TX (US)

(72) Inventors: David Brian Ruth, Austin, TX (US); Philip Dale Chidester, Austin, TX (US); Roy William Stedman, Austin, TX (US); Yuan-Chang Lo, Snoqualmie, WA (US)

(73) Assignee: Motogo, LLC, Austin, TX (US)

( * ) Notice: Subject to any disclaimer, the term of this patent is extended or adjusted under 35 U.S.C. 154(b) by 0 days.

(21) Appl. No.: 17/451,386

(22) Filed: Oct. 19, 2021

(65) Prior Publication Data

US 2022/0117431 A1 Apr. 21, 2022

Related U.S. Application Data

(60) Provisional application No. 63/094,192, filed on Oct. 20, 2020.

(51) Int. Cl.
*A47G 29/30* (2006.01)
*A47G 29/14* (2006.01)

(52) U.S. Cl.
CPC ..... *A47G 29/30* (2013.01); *A47G 29/141* (2013.01); *A47G 2029/144* (2013.01); *A47G 2029/146* (2013.01)

(58) Field of Classification Search
CPC .. A47G 29/30; A47G 29/141; A47G 29/1216; A47G 2029/144; A47G 2029/146; A47G 2029/147; A47G 2029/149; B65D 55/02; E05B 47/0002; E05G 1/005; G07C 9/00912; G07C 9/00896; G07C 9/00182; B25B 1/02; B25B 5/02; F16B 2/12
USPC ..... 232/45, 38, 39, 1 E; 248/231.41, 316.4
See application file for complete search history.

(56) References Cited

U.S. PATENT DOCUMENTS

| | | | | |
|---|---|---|---|---|
| 1,847,969 | A * | 3/1932 | Marks | A47G 29/20 232/42 |
| 9,842,449 | B1 * | 12/2017 | Ruth | G07C 9/00896 |
| 10,292,519 | B1 * | 5/2019 | Sutton | A47K 29/1209 |
| 10,383,471 | B1 * | 8/2019 | Barnes | A47G 29/124 |
| 10,964,143 | B2 * | 3/2021 | Ruth | G07C 9/00896 |
| 11,055,656 | B2 * | 7/2021 | Ruth | G06Q 10/0837 |
| 11,250,652 | B2 * | 2/2022 | Sengstaken, Jr. | G06K 7/10366 |
| 11,330,926 | B1 * | 5/2022 | Root | A47G 29/20 |

(Continued)

*Primary Examiner* — William L Miller
(74) *Attorney, Agent, or Firm* — Moore Intellectual Property Law, PLLC

(57) ABSTRACT

A mountable bracket includes a first leg configured to be coupled to a mounting surface, and a first sub-leg coupled to the first leg. The first leg is extended along a first axis and is configured to project from the mounting surface at a first angle to define a first engagement surface. The first sub-leg projects from the first leg at a second angle to define a second engagement surface. The second engagement surface and at least a portion of the first engagement surface form a first mounting rail configured to mate with a first attachment structure having a first opening width. The first engagement surface and a third engagement surface of a second leg form a second mounting rail configured to mate with a second attachment structure having a second opening width. The second opening width is greater than the first opening width.

29 Claims, 19 Drawing Sheets

(56) References Cited

U.S. PATENT DOCUMENTS

| | | | | |
|---|---|---|---|---|
| 2004/0133304 | A1* | 7/2004 | Fobbe | G07C 9/33 700/214 |
| 2018/0070753 | A1* | 3/2018 | Eveloff | H04W 4/025 |
| 2018/0296016 | A1* | 10/2018 | Teoh | A47G 29/20 |
| 2019/0218828 | A1* | 7/2019 | Ruth | E05B 47/0002 |
| 2019/0259000 | A1 | 8/2019 | Buckhalt | |
| 2019/0350398 | A1* | 11/2019 | Raphael | A47G 29/141 |
| 2020/0387863 | A1* | 12/2020 | Ruth | G06Q 10/0837 |
| 2021/0209543 | A1 | 7/2021 | Scott et al. | |

* cited by examiner

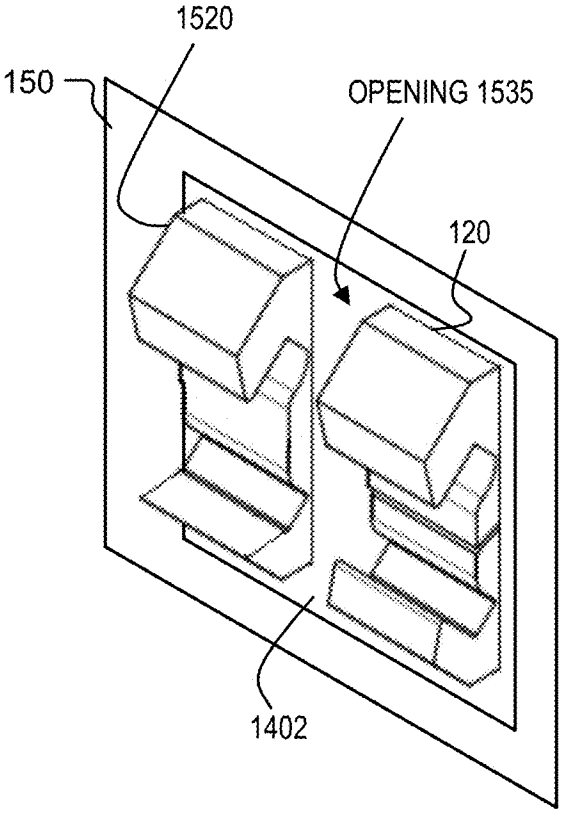
FIG. 15
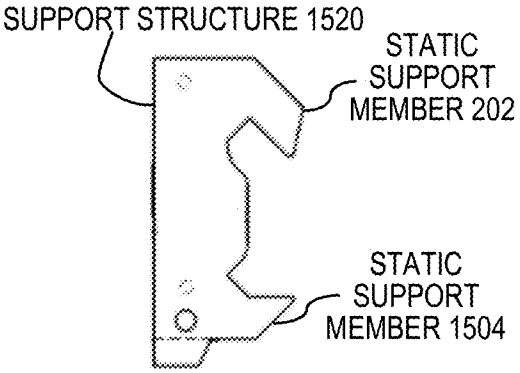

MOUNTABLE BRACKET WITH MULTIPLE MOUNTING RAILS

FIELD

This disclosure relates generally to mountable brackets that can be used to mate with attachment structures with various opening widths.

BACKGROUND

In recent years, consumers have been purchasing more products on-line. Items purchased on-line are often delivered directly to consumers at their residence. When a package is delivered and no one is present to receive it, the package is often left outside the front door and is vulnerable to theft. Current secure package delivery solutions include attempting re-delivery of the package when a resident is present or leaving the package in a neighborhood locker. Leaving the package in a shared locker can be slow because the locker has to be unlocked, a door of the locker has to be opened, the package has to be placed in the locker, the door of the locker has to be closed, the locker has to be locked, and a key of the locker has to be placed in a mailbox of the recipient. A separate locker is needed for each package recipient for secure delivery. The consumer has to plan to be at the residence within a particular re-delivery time window or go to the neighborhood locker to retrieve the package. The shared locker may not have available space for multiple packages or large packages and may not support heavy packages. The consumer can decide to return the package, e.g., because an item is defective or not to the consumer's liking. The package is again vulnerable to theft if left outside for pick-up, or the consumer has to go to a shared locker or a retail location to return the package. These solutions inconvenience the consumers.

SUMMARY

This disclosure provides a mountable bracket that enables secure attachment of attachment structures (e.g., of package containers) to mounting rails. The mountable bracket includes a first leg that is configured to project from a mounting surface (e.g., a wall, a mount member, another mountable bracket, etc.) at a first angle to define a first engagement surface. A first sub-leg of the mountable bracket is configured to project from the mounting surface at a second angle to define a second engagement surface. The second engagement surface and at least a portion of the first engagement surface form a first mounting rail. The first mounting rail has a rail width that enables mating with attachment structures having a first opening width.

The first engagement surface and a third engagement surface of a second leg form a second mounting rail. The second mounting rail has a rail width that enables mating with attachment structures having a second opening width that is greater than the first opening width.

In some examples, an attachment structure includes a movable member that is configured to move between a latched position and an unlatched position to prevent removal in the latched position. In some examples, the first leg and the second leg are included in the same mountable bracket. The mountable bracket (e.g., a single bracket) can thus be used to securely mount multiple package containers of various sizes and various weights, e.g., having attachment structures with various opening widths. For example, the mountable bracket (e.g., a single bracket) can support mounting of a small or light package container on the first mounting rail as well as mounting a larger or heavier package container (e.g., a box) on the second mounting rail. In some examples, the first leg is included in one mountable bracket and the second leg is included in another mountable bracket. For example, multiple mountable brackets can support attachment structures with many different opening widths. In some examples, an attachment structure can be snapped onto a mounting rail thus enabling quick delivery independently of a delivery service (e.g., a delivery person or a delivery robot) having to use any additional hardware tools to securely attach the package container to the mounting rail.

Other aspects of the disclosure will become apparent by consideration of the detailed description and accompanying drawings.

BRIEF DESCRIPTION OF THE DRAWINGS

FIG. 15 is an example implementation of a support structure that can be used with an attachment structure of FIG. 1.

DETAILED DESCRIPTION

For ease of description, each of the exemplary systems presented herein is illustrated with a single exemplar of each of its component parts. Some examples may not describe or illustrate all components of the systems. Other exemplary aspects may include more or fewer of each of the illustrated components, may combine some components, or may include additional or alternative components. Particular aspects are described with reference to the drawings. In the description, common features are designated by common reference numbers throughout the drawings.

In some drawings, multiple instances of a particular type of feature are used. Although these features are physically and/or logically distinct, the same reference number is used for each, and the different instances are distinguished by addition of a letter to the reference number. When the features as a group or a type are referred to herein (e.g., when no particular one of the features is being referenced), the reference number is used without a distinguishing letter. However, when one particular feature of multiple features of the same type is referred to herein, the reference number is used with the distinguishing letter. For example, referring to FIG. 1, multiple attachment structures are illustrated and associated with reference numbers 120A and 120B. When referring to a particular one of these attachment structures, such as the attachment structure 120A, the distinguishing letter "A" is used. However, when referring to any arbitrary one of these attachment structures or to these attachment structures as a group, the reference number 120 is used without a distinguishing letter.

Figure 1:
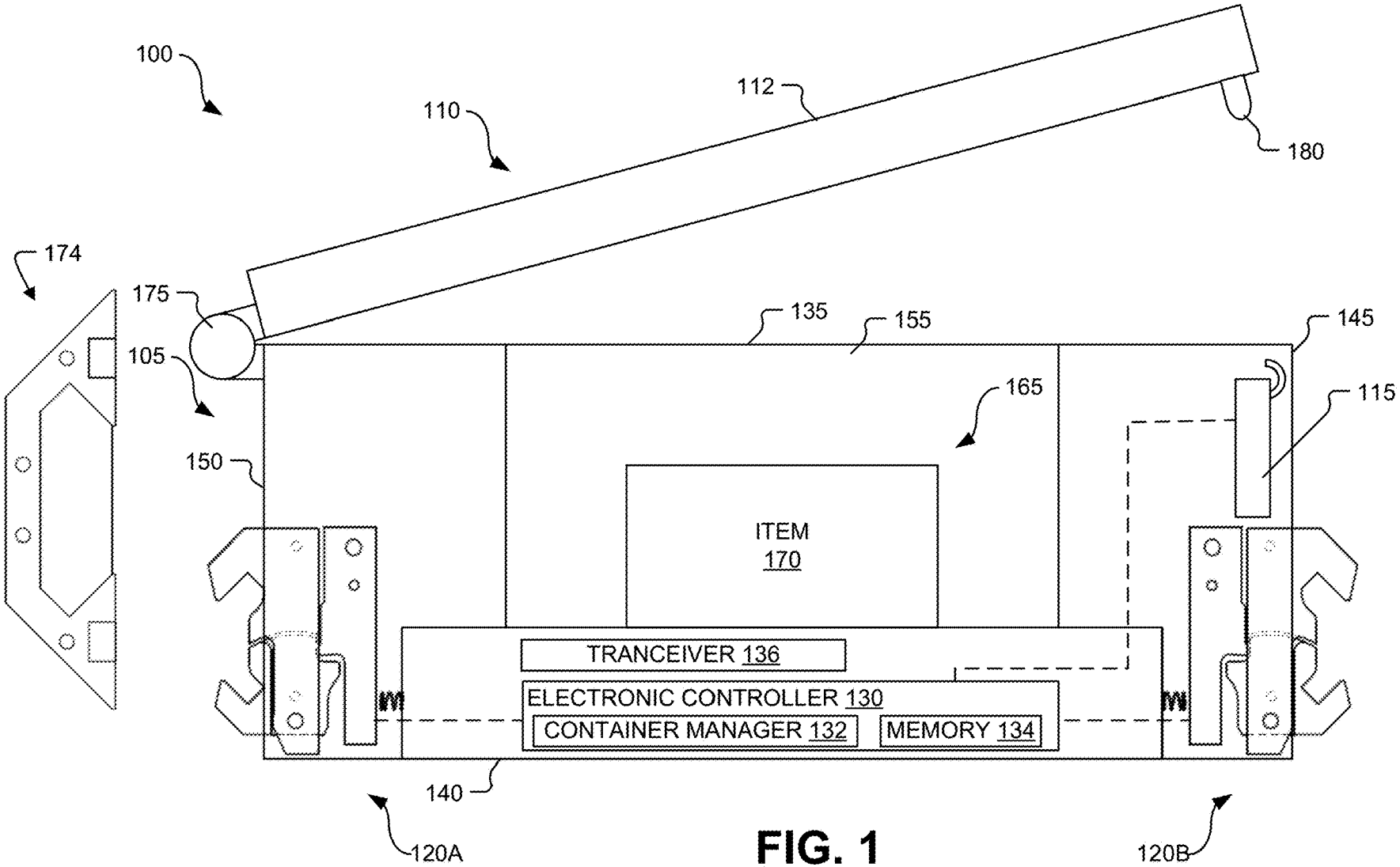
FIG. 1 is a diagram of an example of a package container with attachment structures and an example of a mountable bracket, in accordance with some aspects.

FIG. 1 is a diagram of one exemplary aspect of a package container 100 and a mountable bracket 174. In FIG. 1, the package container 100 is illustrated in an open state. The package container 100 includes a body 105, a cover 110, a cover lock 115, one or more attachment structures 120 (such as an attachment structure 120A and an attachment structure 120B), a user interface 112, and an electronic controller 130. The package container 100 described herein may include fewer, additional, or different components in different configurations than the package container 100 illustrated in FIG. 1. For example, in some aspects, the package container 100 includes only one attachment structure 120 or more than two attachment structures 120.

The body 105 is generally box-shaped. The body 105 includes, among other things, an opening 135, a base 140, a front 145, a back 150, a first side 155, and a second side. The second side is opposite from the first side 155. The opening 135, the base 140, the front 145, the back 150, the first side 155, and the second side define a cavity 165. The cavity 165 holds the item or items being transported. As an illustrative example, an item 170 is disposed within the cavity 165 in FIG. 1. In some examples, multiple items are placed within the cavity 165. In some examples, one or more packages including one or more items are placed within the cavity 165. In alternate aspects, the body 105 may have a generally cylindrical shape (not shown) defined by an opening, a base, and at least one side wall defining a cavity therebetween and coverable with a cover. Other configurations of the body 105 are also suitable so long as they define a cavity for placement of packages, parcels, and other items. The body 105 is described as box-shaped as an illustrative example.

In the example illustrated in FIG. 1, the cover 110 is pivotably coupled to the body 105 via one or more hinges 175. In other examples, the cover 110 is coupled to the body 105 via other types of connectors (for example, sliding connectors). In an open state (illustrated in FIG. 1), the cover 110 is positioned away from the opening 135 such that the cavity 165 is exposed and the contents within the cavity 165 are accessible. In a closed state, the cover 110 is positioned adjacent to the opening 135 such that cavity 165 is secured and the contents within the cavity 165 are not accessible.

The electronic controller 130 includes a container manager 132 (e.g., a processor) to control the package container 100. The electronic controller 130 includes memory 134 configured to store package information, order information, delivery information, security information, status information, trial information, item information, or a combination thereof.

The cover lock 115 is positionable in an unlocked state (illustrated FIG. 1) or a locked state. When the cover 110 is in the closed state and the cover lock 115 is activated (e.g., is in the locked state), the cover lock 115 engages a hook 180 included in the cover 110 to prevent the cover 110 from changing to the open state. Alternatively, when the cover lock 115 is deactivated (e.g., is in the unlocked state), the cover 110 may freely move between the closed state and the open state. The cover lock 115 is electrically coupled to the electronic controller 130. The container manager 132 adjusts the cover lock 115 between the locked and unlocked states by generating and sending control signals to the cover lock 115. In some implementations, the cover 110 includes a membrane and the package container 100 includes a closing mechanism (e.g., an actuator) that self-tightens the membrane around the item 170. In these implementations, the cover 110 is considered to be in a closed state when the membrane is in a tightened state around the item 170. The cover lock 115 is configured, when activated, to prevent the membrane from changing from the tightened state.

The attachment structure 120 is positionable in a latched state (illustrated FIG. 1) or an unlatched state. It should be understood that particular locations (e.g., closer to the base 140 than to the opening 135) of the attachment structure 120 are shown as illustrative examples. In other examples, the attachment structure 120 can be positioned in other locations of the package container 100 (e.g., closer to the opening 135 than to the base 140, projecting from any surface of the package container 100, etc.). When the attachment structure 120 is supported by a mounting rail of the mountable bracket 174 and is in the latched state, the attachment structure 120 prevents removal of the package container 100 from the mountable bracket 174. Alternatively, when the attachment structure 120 is in the unlatched state, the package container 100 may be removed from the mountable bracket 174. In a particular aspect, the attachment structure 120 is electrically coupled to the electronic controller 130. The container manager 132 adjusts the attachment structure 120 between the latched and unlatched states by generating and sending control signals to the attachment structure 120.

Upon delivery to its destination, the package container 100 can be securely attached to the mountable bracket 174 (e.g., a fixed anchor point) via one or more securing mechanisms included in the package container 100. In some examples, the securing mechanism includes the attachment structure 120, as illustrated in FIG. 1. The mountable bracket 174 is attached to a mounting surface. For example, the attachment structure 120 of the package container 100 can be latched onto the mountable bracket 174 that is affixed to the mounting surface of an attachment point. In some examples, the attachment point includes a bar that is attached, for example, to a spot on the ground outside the house of the recipient of the package container 100. In some examples, the attachment point includes a wall. In a particular aspect, the package container 100 remains securely attached to the mountable bracket 174 until the recipient of the package container 100 retrieves the contents placed within the cavity 165 of the package container 100 and a courier transportation resource (e.g., a delivery person, a delivery robot, a delivery vehicle, or a combination thereof) retrieves the package container 100.

In some examples, a mountable bracket 174 includes a mounting surface for another mountable bracket 174, as further described with reference to FIGS. 12C-12D. In some examples, a robotic arm includes a mounting surface. For example, the mountable bracket 174 is attached the robotic arm and the robotic arm uses the mountable bracket 174 to latch onto an attachment structure 120 of a package container 100 to move the package container 100, e.g., onto or from a delivery vehicle or in a warehouse. In some examples, the mountable bracket 174 is coupled via a cable to the mounting surface.

In a particular implementation, the positions of the attachment structure 120 and the mountable bracket 174 can be swapped. For example, the package container 100 includes a mounting surface coupled to the mountable bracket 174 and the attachment structure 120 is coupled to an attachment point. In this implementation, the attachment structure 120 can latch onto the mountable bracket 174 of the package container 100. In a particular aspect, a package container 100 includes one or more of the attachment structures 120, one or more of the mountable brackets 174, or a combination thereof, as further described with reference to FIG. 13.

In some examples, the package container 100 includes a transceiver 136. The user interface 112, the transceiver 136, or both, are operably coupled to the electronic controller 130 to control, for example, the states of the cover lock 115, the attachment structure 120, or both. In a particular aspect, the user interface 112 includes a touchscreen, a keypad, buttons, a microphone, a speaker, an image sensor, or another interface. In some aspects, the container manager 132 receives a code from a user via the user interface 112 (or via the transceiver 136) and deactivates (e.g., changes the state of) the cover lock 115, the attachment structure 120, or both. For example, the container manager 132 changes the attachment structure 120 from a latched state to an unlatched state in response to receiving an unlatch code from the recipient via the user interface 112, from the recipient via the transceiver 136, or from a delivery management server via the transceiver 136. Changing the attachment structure 120 to the unlatched state enables removal of the package container 100 from the mountable bracket 174 by the recipient or a courier transportation resource. In some aspects, the container manager 132 changes the cover lock 115 from the locked state to the unlocked state in response to receiving an unlock code from the recipient via the user interface 112, from the recipient via the transceiver 136, or from a delivery management server via the transceiver 136. Alternatively or in addition, the container manager 132 deactivates (e.g., unlocks) the cover lock 115, unlatches the attachment structure 120, or both, in response to performing a biometric validation. For example, the container manager 132 validates a fingerprint obtained by the user interface 112 (or received via the transceiver 136).

In some examples, the user interface 112 is used to request a return of the item 170. In a particular example, the user interface 112 includes a button that is activated (e.g., pressed) by a user to request return of the package container 100. The user can attach the package container 100 to the mountable bracket 174, if previously removed. The container manager 132, based at least in part on receiving a return request via the user interface 112 (e.g., detecting an activation of the button), initiates provision of return information (e.g., return instructions) to the user, initiates the return process with a seller of delivered items, opens the cover lock 115 to allow placement of any return items in the package container 100, activates the cover lock 115, latches the attachment structure 120, requests pickup of the package container 100, or a combination thereof. The package container 100 can be retrieved by an authorized party (for example, a delivery person of a shipping company or a delivery transportation robot of a logistics company). For example, the user interface 112 can include a button that is activated (e.g., pressed) by the authorized party to initiate removal of the package container 100 from the mountable bracket 174. Alternatively, the transceiver 136 of the package container 100 receives a request from a device of the authorized party to initiate removal. In a particular aspect, the container manager 132, in response to determining that a removal request (in response to activating a removal button or receiving a request via the transceiver 136) is from an authorized party, unlatches the attachment structure 120 from the mountable bracket 174. FIGS. 2A-17D illustrate various views of examples of the attachment structure 120, various views of examples of the mountable bracket 174, or a combination thereof.

Referring to FIGS. 2A-2D, particular views of an example implementation of the attachment structure 120 are shown. The attachment structure 120 has an opening width 210 that enables mating with a mounting rail having a particular rail width that matches (e.g., is less than or equal to) the opening width 210, as further described with reference to FIGS. 7A-7B.

The attachment structure 120 has a static support member 202 and a movable member 204. The movable member 204 is configured to move about a rotation axis 232 between a latched position (illustrated) and an unlatched position. The latched position prevents removal of the attachment structure 120 from a mounting rail, as further described with reference to FIGS. 7A-7B.

In a particular aspect, the attachment structure 120 includes a spring 206. In a particular aspect, the spring 206 is configured to attach to the package container 100. In a particular aspect, the attachment structure 120 is attached to the package container 100 (e.g., with a pin that passes through a hole 230 with ends coupled to the package container 100) such that the spring 206 enables the attachment structure 120 to move about a rotation axis 234.

In a particular aspect, the attachment structure 120 is included in an attachment interface (e.g., a housing) and the attachment interface is attached to (e.g., included in) the package container 100, as further described with reference to FIG. 14. In this aspect, the static support member 202 is fixed to the attachment interface, the spring 206 is constrained within the attachment interface, or both. In a particular example, a first pin passes through the hole 230, a second pin passes through a hole 236, or both. Ends of the first pin, ends of the second pin, or a combination thereof, are anchored in (e.g., coupled to) the package container 100 or the attachment interface.

Figure 3C:
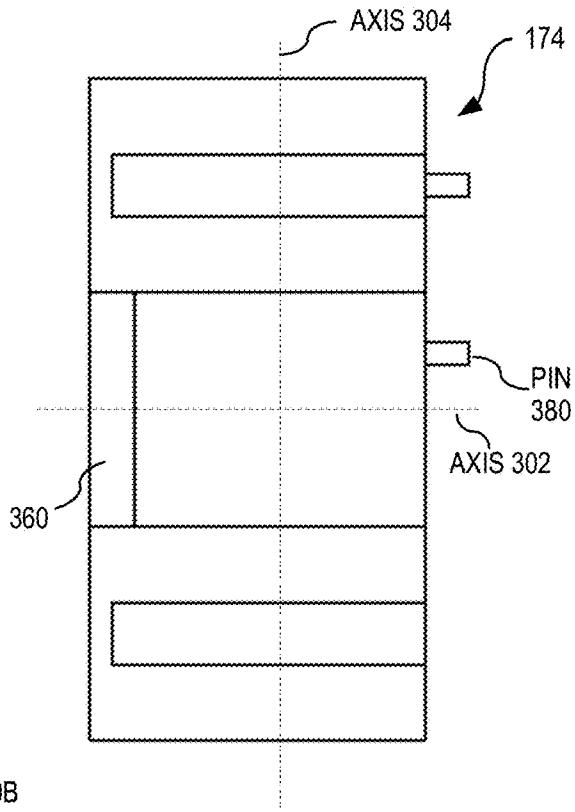
FIG. 3C is another particular view of the mountable bracket of FIG. 3A.
Figure 3B:
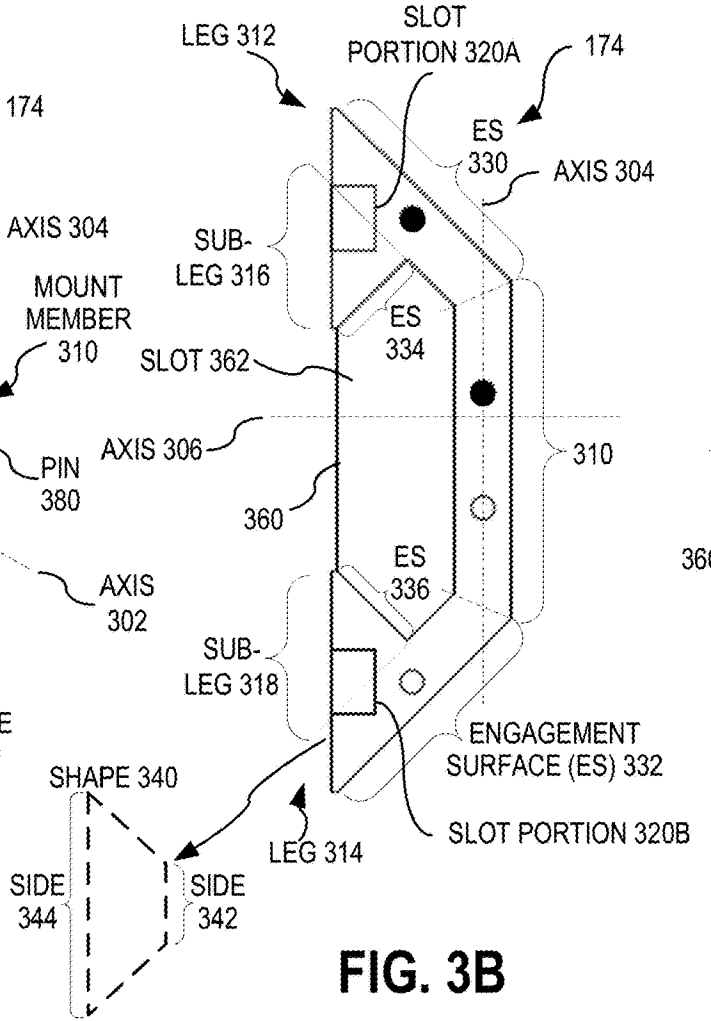
FIG. 3B is another particular view of the mountable bracket of FIG. 3A.
Figure 3A:
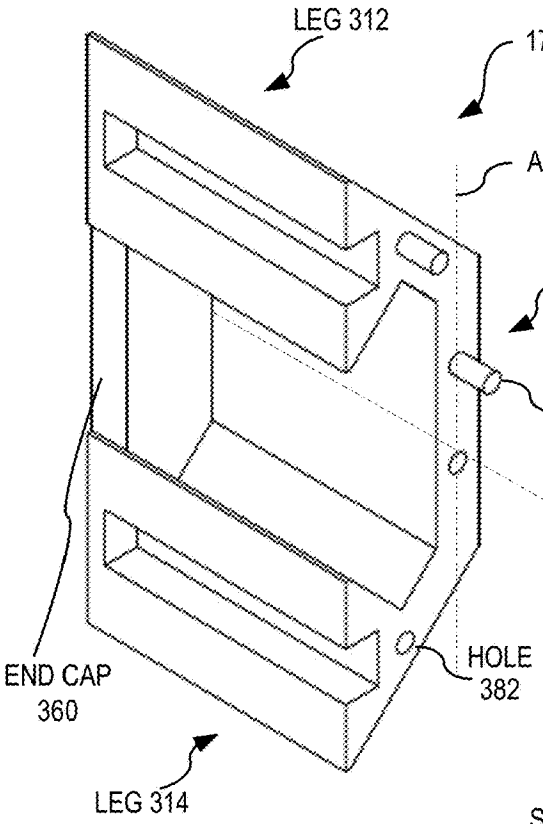
FIG. 3A is a particular view of an example implementation of the mountable bracket of FIG. 1.

Referring to FIGS. 3A-3C, particular views of an example implementation of the mountable bracket 174 are shown. The mountable bracket 174 includes a mount member 310 configured to be attached to a mounting surface (e.g., of a wall, another mountable bracket, a delivery truck, a robotic arm, a package container, etc.).

In a particular aspect, the mount member 310 is configured to be coupled via a cable (e.g., a detachable cable or an undetachable cable) to the mounting surface, as further described with reference to FIG. 13. The mount member 310 has a length that extends along an axis 302, a width that extends along an axis 304, and a thickness that extends along an axis 306. The axis 302, the axis 304, and the axis 306 are mutually orthogonal.

The mountable bracket 174 includes a leg 312 coupled to the mount member 310 and extended along the axis 302. The leg 312 projects from the mount member 310 at a first angle to define an engagement surface (ES) 330. The first angle is in a first plane defined by the axis 304 and the axis 306. The first angle is not parallel to the axis 304 and is not parallel to the axis 306.

The mountable bracket 174 includes a sub-leg 316 coupled to the leg 312 and extended along the axis 302. The sub-leg 316 projects from the leg 312 at a second angle to define an engagement surface 334. The second angle is in the first plane. The first angle and the second angle are congruent angles on opposite sides of a line parallel to the axis 306. For example, the first angle and the second angle are greater than 0 degrees and less than 90 degrees (e.g., 45 degrees) on opposite sides of a line parallel to the axis 306.

The mountable bracket 174 includes a leg 314 coupled to the mount member 310 and extended along the axis 302. The leg 314 projects from the mount member 310 at the second angle to define an engagement surface 332. The mountable bracket 174 includes a sub-leg 318 coupled to the leg 314 and extended along the axis 302. The sub-leg 318 projects from the leg 314 at the first angle relative to the axis 304 and the axis 306 to define an engagement surface 336.

The engagement surface 334 and a portion of the engagement surface 330 form a first mounting rail configured to mate with an attachment structure 120 having a first opening width that matches a first rail width of the first mounting rail. For example, the attachment structure 120 includes a latching mechanism (e.g., a movable member 204) that engages the engagement surface 334. To illustrate, the first mounting rail is configured to mate with an attachment structure 120 such that a movable member 204 of the attachment structure 120 can latch onto the engagement surface 334 while the static support member 202 of the attachment structure 120 is supported by the portion of the engagement surface 330. An example of an attachment structure mated with a mounting rail is further described with reference to FIGS. 7A-7B.

The engagement surface 336 and a portion of the engagement surface 332 form a second mounting rail configured to mate with an attachment structure 120 having the first opening width that matches the first rail width of the second mounting rail. For example, the second mounting rail has the same rail width as the first mounting rail, and an attachment structure 120 having the first opening width can be latched to either one of the first mounting rail or the second mounting rail.

The engagement surface 330 and the engagement surface 332 form a third mounting rail configured to mate with an attachment structure 120 having a second opening width that matches a second rail width of the third mounting rail. The second opening width is greater than the first opening width. For example, the third mounting rail has a greater rail width than each of the first mounting rail and the second mounting rail, and an attachment structure 120 having the second opening width (e.g., a larger opening width) can be latched to the third mounting rail.

In some implementations, smaller package containers 100 use attachment structures 120 with smaller opening widths (e.g., the first opening width), and larger package containers 100 use attachment structure 120 with larger opening widths (e.g., the second opening width). In such implementations, the first mounting rail or the second mounting rail of the mountable bracket 174 can be used to mate with the attachment structures 120 of the smaller package container 100, and the third mounting rail of the mountable bracket 174 can be used to mate with the attachment structure 120 of the larger package containers 100. Thus, a single mountable bracket 174 can accommodate different sizes of attachment structures 120 and package containers 100.

Figure 10B:
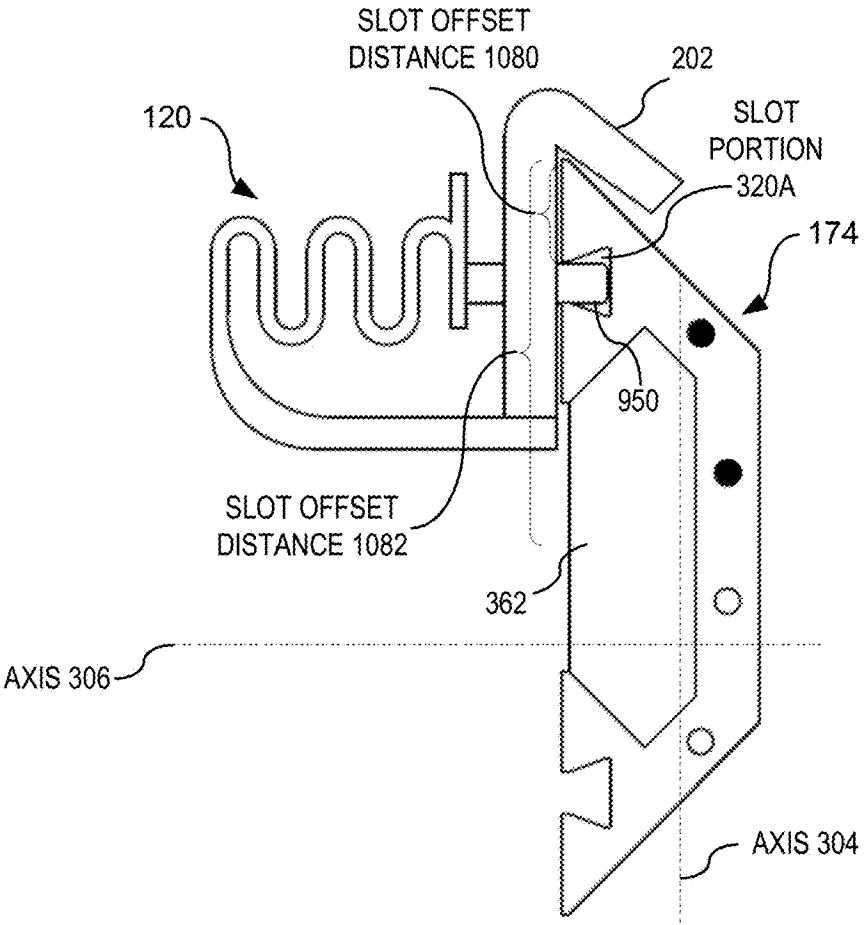
FIG. 10B is another particular view of the attachment structure attached to the mountable bracket of FIG. 10A.
Figure 10A:
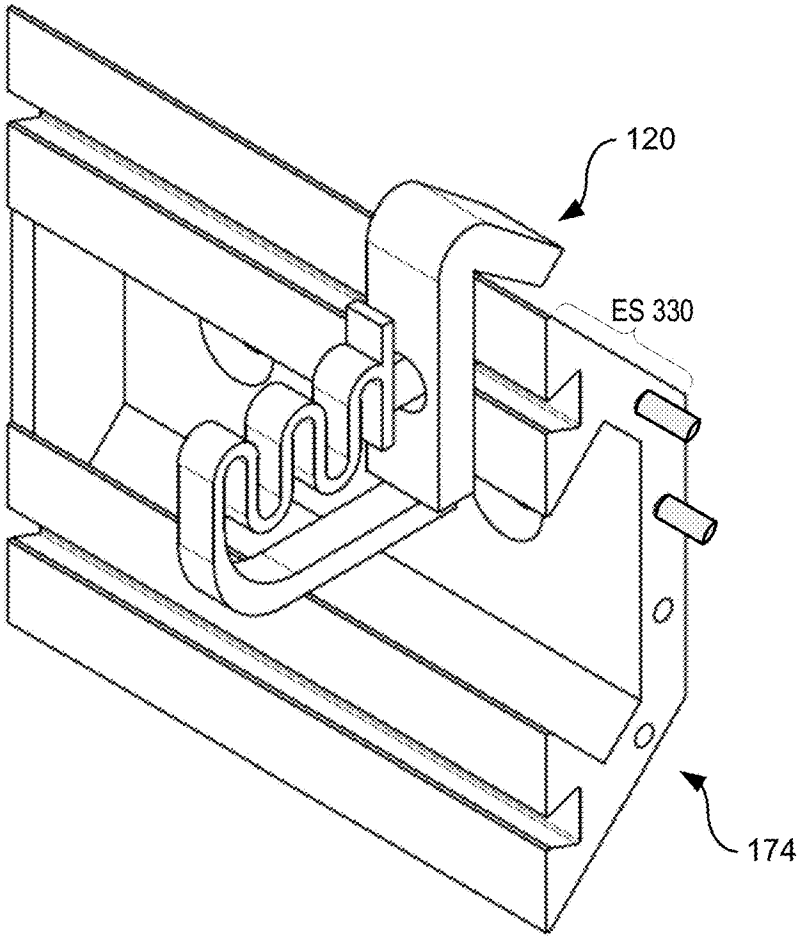
FIG. 10A is a particular view of an example of the attachment structure of FIG. 9 attached to an example implementation of the mountable bracket of FIG. 1.

A portion of the leg 312 and the sub-leg 316 define a shape 340 (e.g., a trapezoidal shape) in the first plane. A portion of the leg 314 and the sub-leg 318 define the shape 340 (e.g., the trapezoidal shape) in the first plane. The shape 340 includes a side 342 that is opposite and parallel to a side 344 of the shape 340. The side 342 is shorter than the side 344. The shape 340 includes a slot portion 320 along the side 344 of the shape 340. For example, the shape 340 defined by the portion of the leg 312 and the sub-leg 316 includes a slot portion 320A. As another example, the shape 340 defined by the portion of the leg 314 and the sub-leg 318 includes a slot portion 320B. The slot portion 320 includes an open space. The open space of the slot portion 320 defines a rectangular shape in the example illustrated in FIGS. 3A-3B, a trapezoidal shape as illustrated in the example of FIGS. 10A-10B, or another shape, in the first plane.

In a particular aspect, the mountable bracket 174 includes an end cap 360. In the example illustrated in FIGS. 3A-3C, the end cap 360 extends from an end portion of the sub-leg 316 to an end portion of the sub-leg 318. In other examples, the end cap 360 extends between the leg 312 and the leg 314. The end cap 360 prevents an attachment structure 120 attached to the mountable bracket 174 from sliding off an end of the mountable bracket 174.

The mountable bracket 174 includes an open space defining a slot 362. The open space of the slot 362 defines a particular shape (e.g., a hexagon shape) in the first plane. The slot 362 extends from the end cap 360 along the axis 302. In a particular aspect, the mountable bracket 174 includes a second end cap at a second end of the mountable bracket. In this aspect, the slot 362 extends from the end cap 360 to the second end cap along the axis 302.

In a particular aspect, the mountable bracket 174 is modular to enable multiple mountable brackets or mountable bracket pieces to be combined to form a mountable bracket of a desired length. For example, the mountable bracket 174 includes one or more pins 380, one or more holes 382, or a combination thereof. A hole 382 has a hole depth along the axis 302 that is greater than equal to a length of a pin 380 along the axis 302. The pins 380 are positioned on the mountable bracket 174 to align with one or more holes of a second mountable bracket, the holes 382 are positioned on the mountable bracket 174 to align with one or more pins of the second mountable bracket, or a combination thereof.

The mountable bracket 174 can be mounted in any alignment on a mounting surface. In a particular aspect, the mountable bracket 174 is mounted in a vertical alignment (e.g., 90 degrees). For example, the axis 302 corresponds to a vertical axis (e.g., y-axis) on the mounting surface. In a particular aspect, the mountable bracket 174 is mounted in a horizontal alignment (e.g., 0 degrees). For example, the axis 302 corresponds to a horizontal axis (e.g., x-axis) on the mounting surface. In a particular aspect, the mountable bracket 174 is mounted in a diagonal alignment (e.g., greater than 0 degrees and less than 90 degrees). For example, the axis 302 corresponds to a diagonal axis (e.g., between the x-axis and the y-axis) on the mounting surface.

In a particular aspect, a first mountable bracket 174 can be mounted in a first alignment on a mounting surface, and a second mountable bracket 174 can be mounted in a second alignment on the mounting surface. In some examples, the first alignment is the same as the second alignment. To illustrate, the first mountable bracket 174 is mounted parallel to the second mountable bracket 174 on the mounting surface. In some examples, the first alignment is different from the second alignment. To illustrate, the first mountable bracket 174 is mounted perpendicular or diagonal to the second mountable bracket 174 on the mounting surface.

In some aspects, the mountable bracket 174 can include one or more gaps (e.g., holes) to enable rainwater or debris to pass through. For example, the mountable bracket 174 can include one or more perforations. In some aspects, a surface of the mount member 310 that is configured to be mounted to a mounting surface can be uneven, e.g., ridged, to enable rainwater or debris to pass through.

Figure 4:
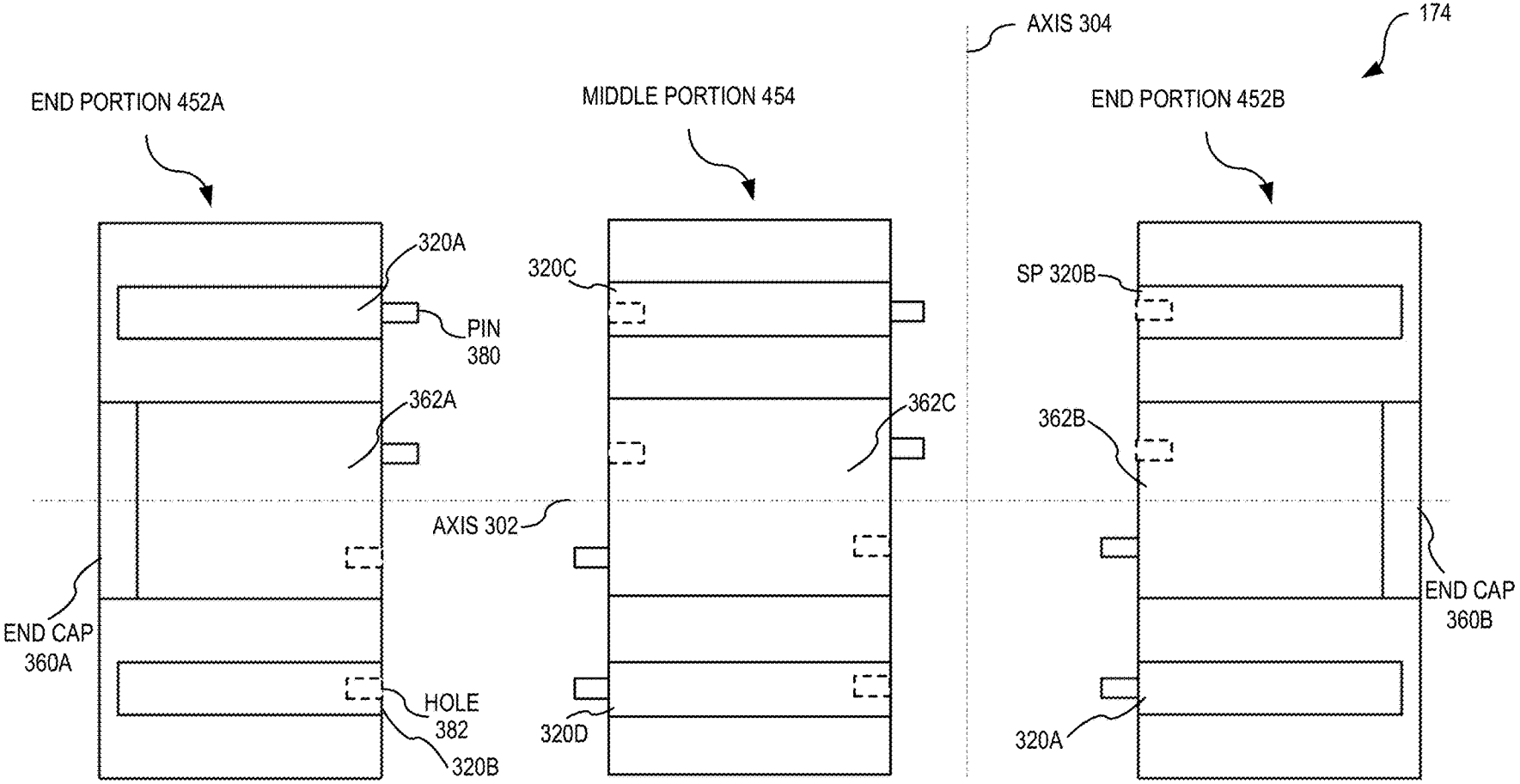
FIG. 4 is a diagram of an example implementation of the mountable bracket of FIG. 1 with combinable portions.

Referring to FIG. 4, an example implementation of the mountable bracket 174 is shown. The mountable bracket 174 includes combinable portions. For example, the mountable bracket 174 includes an end portion 452A, one or more middle portions 454, and an end portion 452B. In some implementations, the end portion 452B and the end portion 452A are identical and attached in different orientations (e.g., rotated about the axis 306, the axis 304, or both with respect to one another) in the mountable bracket 174.

Each end portion 452 includes an end cap 360, a slot portion 320A, and a slot portion 320B. For example, the end portion 452A includes an end cap 360A, a slot portion 320A, and a slot portion 320B. The end portion 452B includes an end cap 360B, a slot portion 320A, and a slot portion 320B. The slot portion 320 extends along the axis 302 from a first end of the slot portion 320 to a second end of the slot portion 320. The end cap 360 is closer to the first end of the slot portion 320 than to the second end of the slot portion 320. In a particular aspect, the first end of the slot portion 320 is blocked and the second end of the slot portion 320 is open.

Each middle portion 454 includes the slot portion 320. For example, in FIG. 4, the middle portion 454 includes a slot portion 320C and a slot portion 320D. The slot portion 320 of the middle portion 454 includes open space extending from a first end to a second end of the middle portion 454 along the axis 302. In a particular aspect, the middle portion 454 differs from the end portion 452 in that both ends (e.g., the first end and the second end) of the slot portion 320 of the middle portion 454 are unblocked and include open space, that the middle portion 454 does not include an end cap, or a combination thereof.

In a particular aspect, each of the middle portion 454 and the end portion 452 of the mountable bracket 174 includes the slot 362. For example, the end portion 452A, the end portion 452B, and the middle portion 454 include the slot 362A, the slot 362B, and the slot 362C, respectively. The slot 362 of the end portion 452 includes open space extending along the axis 302 from an end cap 360 to a second end of the slot 362. In a particular aspect, the second end of the slot 362 is open. The slot 362 of the middle portion 454 includes open space extending along the axis 302 from a first end of the slot 362 to a second end of the slot 362. In a particular aspect, both ends of the slot 362 of the middle portion 454 are unblocked and include open space.

In a particular aspect, the end portion 452, the middle portion 454, or both, include one or more pins 380, one or more holes 382, or a combination thereof. The pins 380 of the end portion 452 are positioned to align with holes 382 of the middle portion 454. The holes 382 of each end portion 452 are positioned to align with pins 380 of another end portion 452. In a particular aspect, the holes 382 are shown with dotted lines to indicate that the holes 382 are not generally externally visible in the illustrated view. In a particular aspect, the end portion 452A, one or more of the middle portion 454, and the end portion 456B can be pushed together so that the corresponding pins 380 and holes 382 are mated to form the mountable bracket 174. A length of the mountable bracket 174 along the axis 302 can thus be increased or decreased by adding or removing one or more of the middle portions 454. In a particular aspect, the end portion 452A can be combined with the end portion 456B independently of the middle portion 454.

In a particular aspect, up to two of the end portion 452 and any number (e.g., any count greater than or equal to 0) of the middle portion 454 can be used to form a mountable bracket 174. In some examples, the mountable bracket 174 includes a single portion, such as an end portion 452 or a middle portion 454. In some examples, the single portion is without pins 380 and without holes 382. In some example, the single portion includes up to two end caps 360. In other examples, the mountable bracket 174 includes multiple portions of the same type, e.g., two end portions 452 or at least two middle portions 454. In some examples, the mountable bracket 174 includes multiple portions of mixed types, e.g., one or two end portions 452 and at least one middle portion 454. In a particular aspect, each of multiple portions of the mountable bracket 174 is of the same length. In an alternative aspect, the mountable bracket 174 includes multiple portions with some of the multiple portions of different lengths. For example, an end portion 452A is of a different length than a middle portion 454, an end portion 452B, or both. In a particular example, a middle portion 454A is of a different length than a middle portion 454B.

Figure 5:
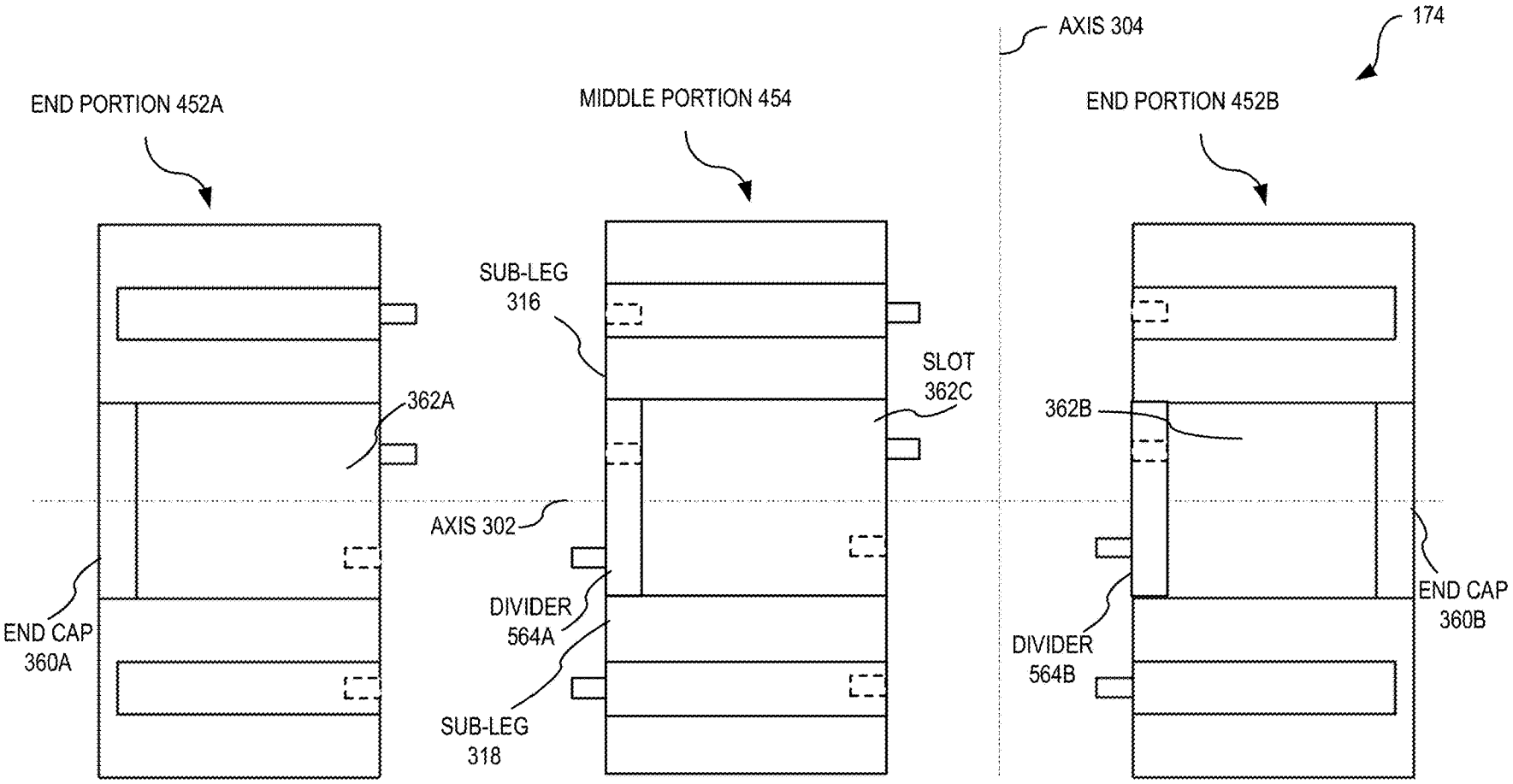
FIG. 5 is a diagram of another example implementation of the mountable bracket of FIG. 1 with combinable portions.

Referring to FIG. 5, an example implementation of the mountable bracket 174 is shown. In a particular aspect, at least one portion of the mountable bracket 174 includes a divider 564 extending along the axis 304 (e.g., from a portion of the sub-leg 316 to a portion of the sub-leg 328). For example, the middle portion 454 includes at least one divider 564A and an end portion 452B includes a divider 564B. In a particular aspect, the divider 564 is removable and one or more of the dividers 564 can be added when assembling the mountable bracket 174. It should be understood that dividers 564 are shown at ends of the middle portion 454 and the end portion 452B as illustrative examples. In some examples, a divider 564 can be added at any location along the axis 302 in the slot 362 of the mountable bracket 174.

In a particular aspect, the dividers 564 define separate bracket portions of the mountable bracket 174 along the axis 302. For example, if the mountable bracket 174 includes the end portion 452, the middle portion 454, and the end portion 452B, a first bracket portion extends from an end cap 360A of the end portion 452 to a divider 564A of the middle portion 454, a second bracket portion extends from the divider 564A to the divider 564B of the end portion 452B, and a third bracket portion extends from the divider 564B to an end cap 360B of the end portion 452B.

In a particular aspect, each of the separate bracket portions of the mountable bracket 174 is individually addressable. In a particular aspect, each of the bracket portions indicates a corresponding bracket address. For example, the first bracket portion, the second bracket portion, and the third bracket portion indicate a first bracket address, a second bracket address, and a third bracket address, respectfully. In a particular aspect, a bracket address is readable by a user device, a package container 100, a sensor of (e.g., coupled to) the mountable bracket 174, or a combination thereof. In a particular aspect, an attachment structure 120 indicates a corresponding attachment structure identifier. In a particular aspect, the attachment structure identifier is readable by a user device, a sensor of (e.g., coupled to) the mountable bracket 174, a package container 100, or a combination thereof.

In a particular aspect, in response to an attachment structure 120 latching onto a bracket portion of a mountable bracket 174, a notification (e.g., a delivery notification) is sent to a user indicating a bracket address of the bracket portion, an attachment structure identifier of the attachment structure 120, a package identifier of a package container 100 (attached to the attachment structure 120 or the mountable bracket 174), or a combination thereof. In some examples, the notification is sent by a user device in response to a user (e.g., a delivery person) scanning the bracket address, the attachment structure identifier, or both.

In some examples, the notification is sent by the container manager 132 in response to detecting that the attachment structure 120 has latched onto the mountable bracket 174 and determining that the attachment structure 120 having the attachment structure identifier is latched to a bracket portion having the bracket address. In some implementations, the container manager 132 determines that the attachment structure 120 is latched to the bracket portion having the bracket address based on sensor data received from a sensor (e.g., an image sensor). For example, the sensor data indicates a radio frequency identification (RFID), near field communication (NFC) data, a barcode, a universal product code (UPC), another smart tag, a beacon signal from the bracket portion, or a combination thereof. In some implementations, the container manager 132 determines that the attachment structure 120 is latched to the bracket portion having the bracket address in response to receiving the bracket address via an interconnect of the attachment structure 120 from an interconnect of the mountable bracket 174, as further described with reference to FIGS. 11A-11B.

In some examples, the notification is sent by a bracket manager coupled to the mountable bracket 174 in response to detecting that an attachment structure 120 has latched onto a bracket portion of the mountable bracket 174 and determining that the attachment structure 120 having the attachment structure identifier has latched onto the bracket portion having the bracket address. In some implementations, the bracket manager determines that the attachment structure 120 having the attachment structure identifier has latched onto the bracket portion having the bracket address based on sensor data received from a sensor (e.g., an image sensor). For example, the sensor data indicates a RFID, NFC data, a barcode, a UPC, another smart tag, a beacon signal from the package container 100, or a combination thereof. In some implementations, the bracket manager determines that the attachment structure 120 having the attachment structure identifier has latched onto the bracket portion having the bracket address in response to receiving the attachment structure identifier via an interconnect of the mountable bracket 174 from an interconnect of the attachment structure 120, as further described with reference to FIGS. 11A-11B.

Figure 6B:
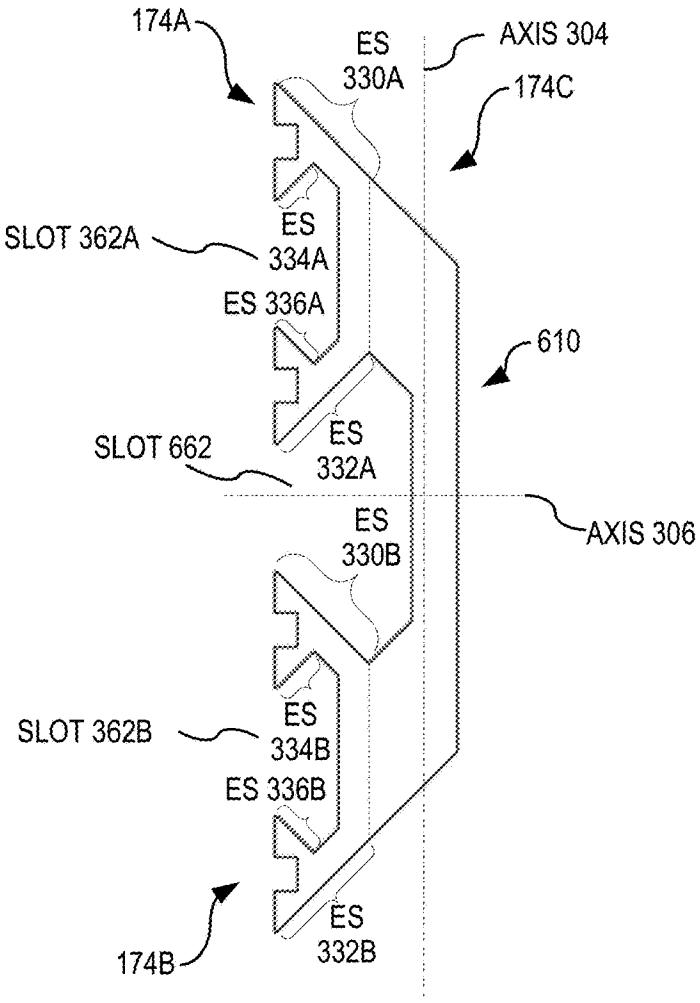
FIG. 6B is another particular view of the mountable bracket of FIG. 6A.
Figure 6A:
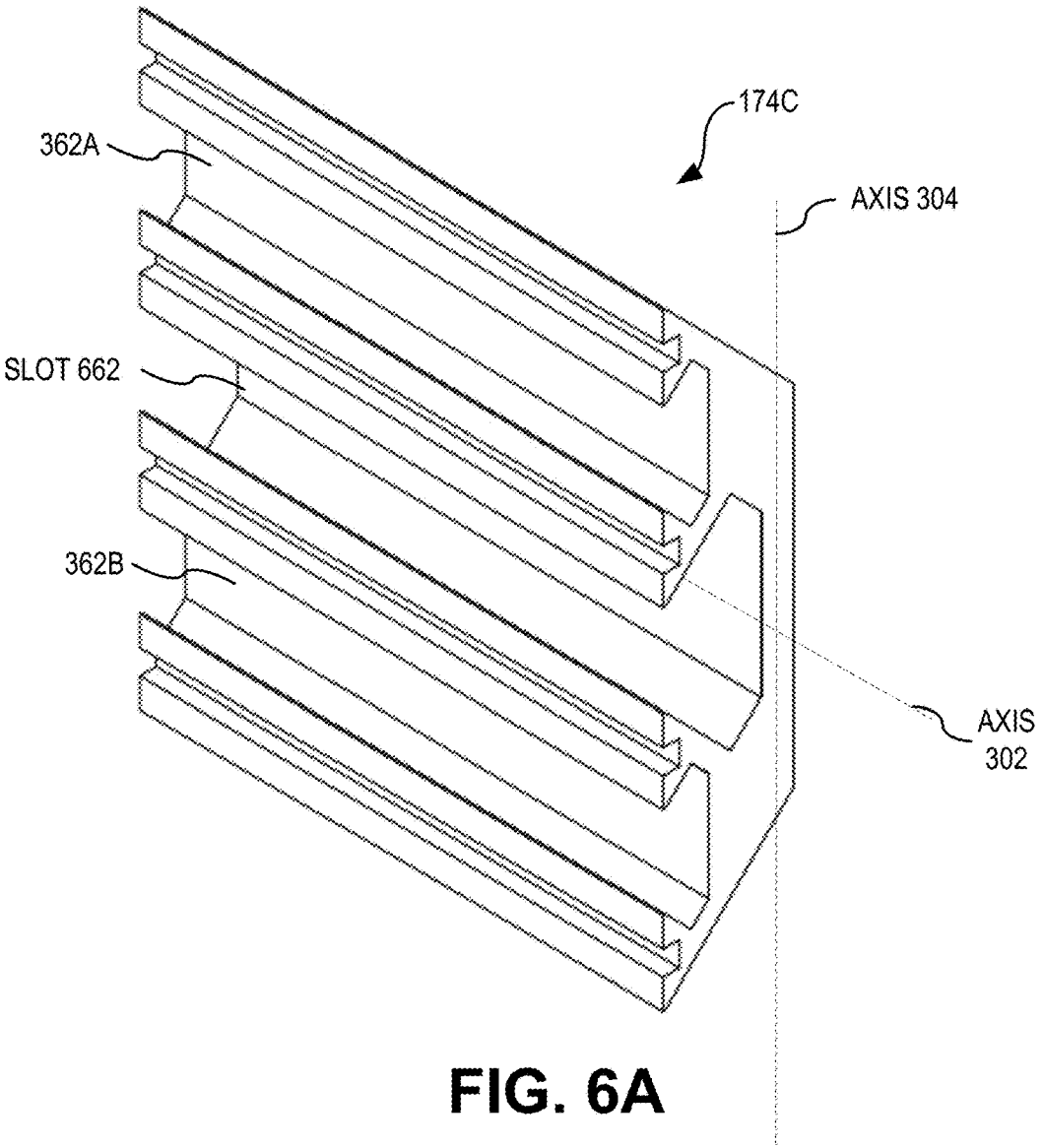
FIG. 6A is a particular view of an example implementation of the mountable bracket of FIG. 1.

Referring to FIGS. 6A-6B, particular views of an example implementation of the mountable bracket 174 are shown. For example, a mountable bracket 174C is formed by attaching a mountable bracket 174A to a mountable bracket 174B.

The mountable bracket 174C includes a mount member 610 having a length that extends along the axis 302. The mount member 610 is configured to attach to a mounting surface (e.g., of a wall, a package container 100, another mount member, another mountable bracket 174, or another type of mounting surface). The mount member 610 is coupled to a mountable bracket 174A and a mountable bracket 174B. For example, the mount member 610 is coupled to a mount member 310A of the mountable bracket 174A and to a mount member 310B of the mountable bracket 174B. To illustrate, the mount member 610 of the mountable bracket 174C corresponds to a mounting surface for each of the mountable bracket 174A and the mountable bracket 174B. The mountable bracket 174C includes an open space defining a slot 662. The open space of the slot 662 defines a particular shape (e.g., a hexagon shape) in the first plane (e.g., defined by the axis 304 and the axis 306). The slot 662 extends along the axis 302. The mountable bracket 174C is shown as formed by attaching one mount member 610 to two mountable brackets 174 as an illustrative example. In other examples, the mountable bracket 174C can include any count of mount members and any count of mountable brackets 174 arranged in various combinations. The mountable bracket 174C is shown as formed by attaching same-sized mountable brackets 174 to the mount member 610 as an illustrative example. In other examples, the mountable bracket 174C can be formed using mountable brackets 174 of various sizes. The mountable bracket 174 can thus include mounting rails of multiple rail widths that are configured to mate with attachment structures of different sizes.

In a particular aspect, at least a portion of an engagement surface of the mountable bracket 174A and at least a portion of an engagement surface of the mountable bracket 174B form a mounting rail. For example, at least a portion of an engagement surface 330A and an engagement surface 334B form a first mounting rail having a first rail width. The first mounting rail is configured to mate with an attachment structure 120 having a first opening width. In another example, at least a portion of the engagement surface 330A and at least a portion of the engagement surface 332B form a second mounting rail having a second rail width. The second mounting rail is configured to mate with an attachment structure 120 having a second opening width. The second rail width is greater than the first rail width, and the second opening width is greater than the first opening width.

In a particular example, the engagement structure 336A and the portion of the engagement surface 332B form a third mounting rail having the first rail width. The third mounting rail is configured to mate with an attachment structure 120 having the first opening width. In a particular example, the engagement structure 336A and the engagement surface 334B form a fourth mounting rail having a third rail width. The fourth mounting rail is configured to mate with an attachment structure 120 having a third opening width.

In a particular aspect, each of the first mounting rail, the second mounting rail, the third mounting rail, or the fourth mounting rail is configured to mate with multiple attachment structures 120 at the same time. For example, an attachment structure 120A can be latched to one of the first mounting rail, the second mounting rail, the third mounting rail, or the fourth mounting rail at the same time as an attachment structure 120B is latched to another of the first mounting rail, the second mounting rail, the third mounting rail, or the fourth mounting rail. The attachment structure 120A and the attachment structure 120B can be latched to the same mounting rail or to different mounting rails having the same rail width if the attachment structure 120A has the same opening width as the attachment structure 120B. In a particular example, the attachment structure 120A and the attachment structure 120B can be latched to different mounting rails if the attachment structure 120A has a different opening width as compared to the attachment structure 120B.

Figure 7B:
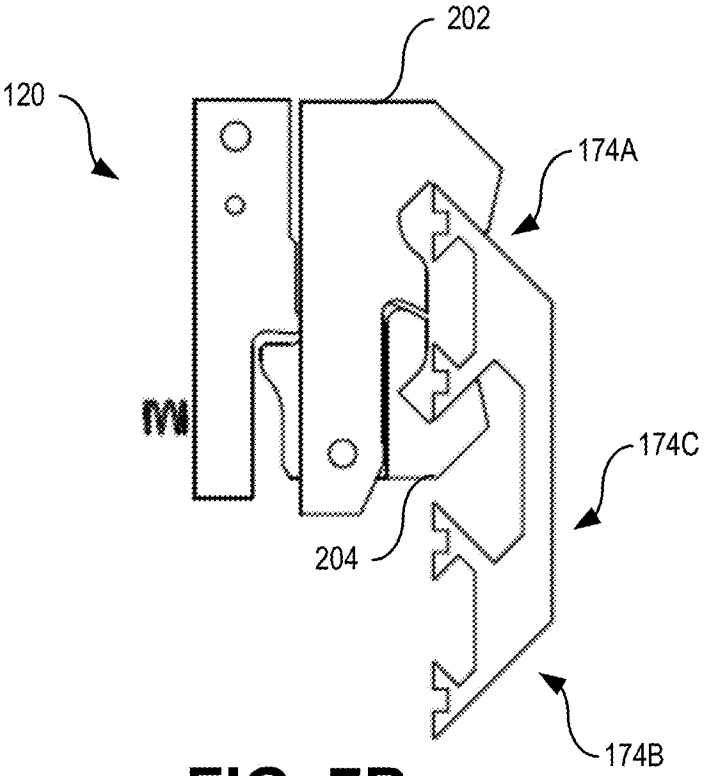
FIG. 7B is another particular view of the attachment structure attached to the mountable bracket of FIG. 7A.
Figure 7A:
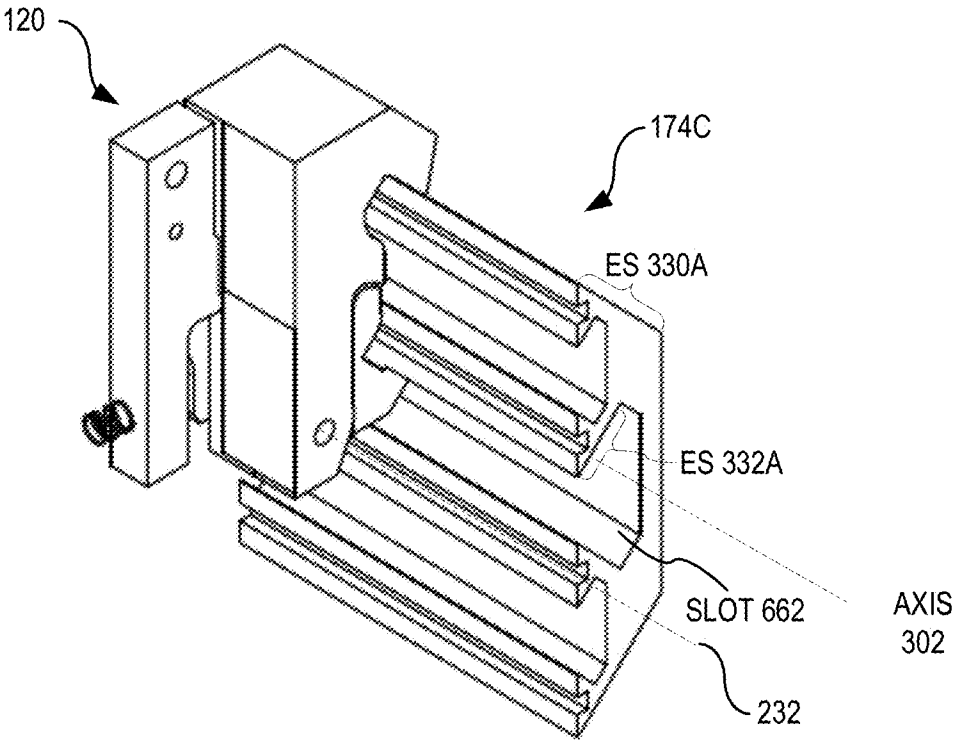
FIG. 7A is a particular view of an example of the attachment structure of FIG. 2 attached to the mountable bracket of FIG. 6.

Referring to FIGS. 7A-7B, particular views of the attachment structure 120 attached to the mountable bracket 174 are shown. For example, the attachment structure 120 is latched to a mounting rail of the mountable bracket 174C formed by a portion of the engagement surface 330A and a portion of the engagement surface 332A.

In a particular aspect, the movable member 204 of the attachment structure 120 is in an unlatched position prior to placement on the mountable bracket 174C. When the attachment structure 120 is placed on the mountable bracket 174C, the movable member 204 is rotatable about the rotation axis 232 from the unlatched position to a latched position. In the latched position, the static support member 202 is supported by the portion of the engagement surface 330A, and the movable member 204 is latched on the portion of the engagement surface 332A.

In a particular aspect, in response to receiving a release control signal (e.g., from the container manager 132, a user device, or a bracket manager), the movable member 204 is unlatched from the portion of the engagement surface 332A. For example, the container manager 132, in response to receiving a user input from a user (e.g., a delivery person) via the user interface 112 or the transceiver 136, sends a release control signal to the attachment structure 120 to unlatch the movable member 204. The movable member 204, in response to the release control signal, rotates about the rotation axis 232 from the latched position to the unlatched position.

FIGS. 7A and 7B illustrate a single attachment structure 120 attached to the mountable bracket 174C as an illustrative example. In other examples, multiple attachment structures 120 are attached to the mountable bracket 174C. For example, multiple attachment structures 120 can be attached to the mountable bracket 174C on the same or different mounting rails. In a particular aspect, multiple attachment structures 120 can be attached to the mountable bracket 174 offset along the axis 302. In a particular aspect, smaller attachment structures 120 can be attached to smaller mounting rails (e.g., with smaller rail widths) and larger attachment structures 120 can be attached to larger mounting rails (e.g., with larger rail widths).

Figure 8C:
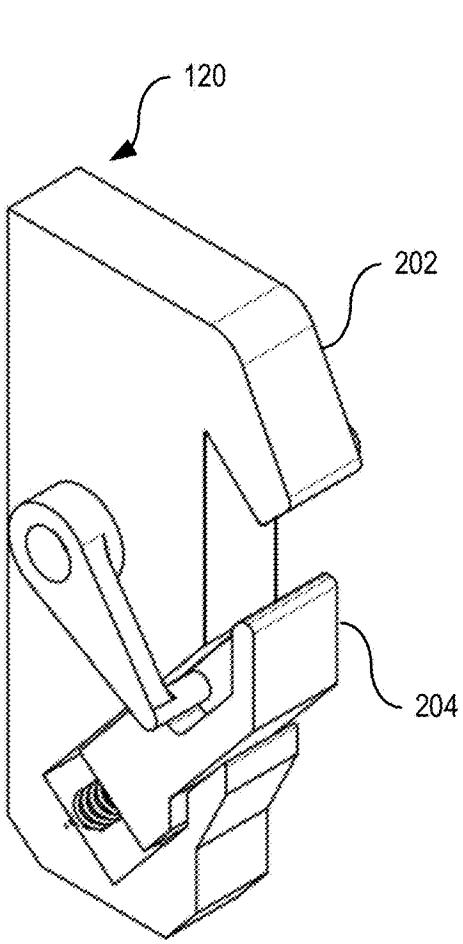
FIG. 8C is another particular view of the attachment structure of FIG. 8A.
Figure 8B:
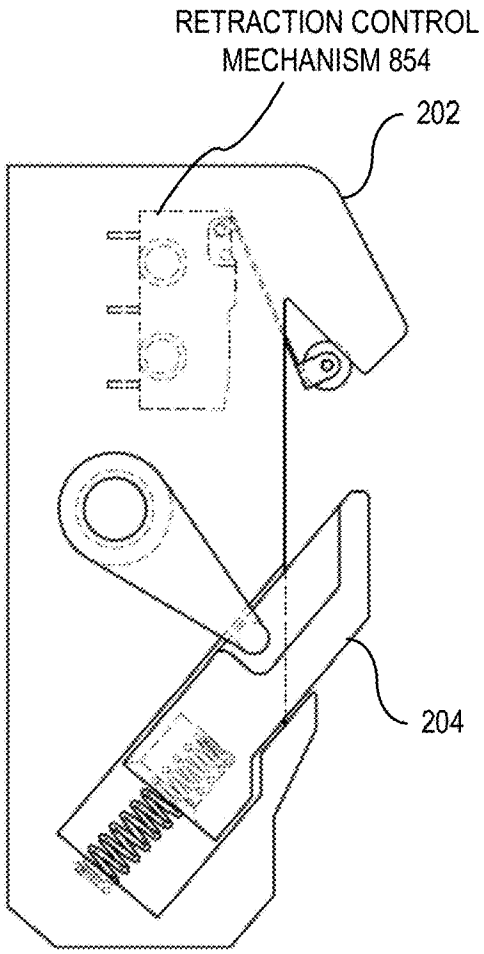
FIG. 8B is another particular view of the attachment structure of FIG. 8A.
Figure 8A:
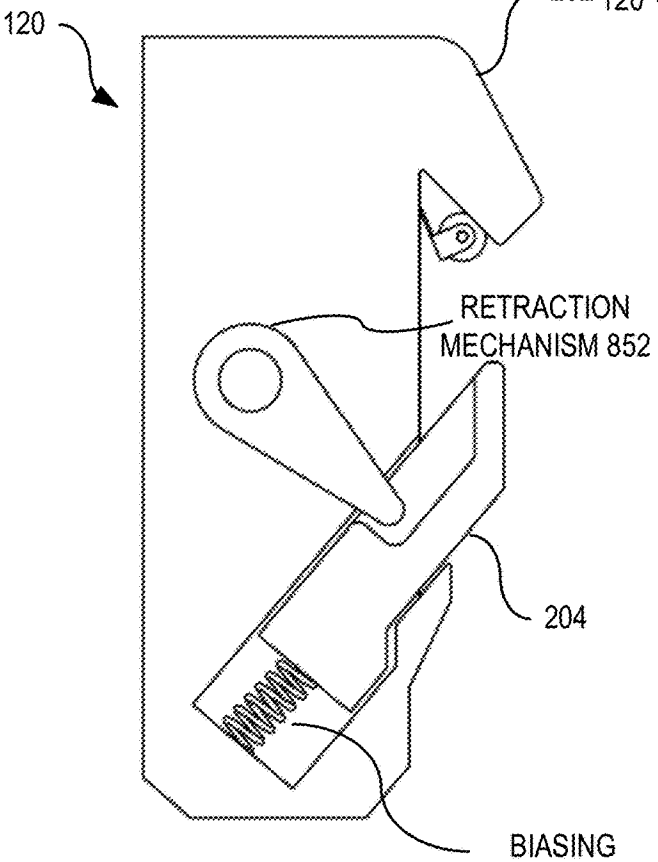
FIG. 8A is a particular view of an example implementation of an attachment structure of FIG. 1.

Referring to FIGS. 8A-8C, particular views of an example implementation of the attachment structure 120 are shown. In a particular aspect, the movable member 204 is attached to a biasing member 850. The biasing member 850 is configured to apply a bias force to keep the movable member 204 in a latched position unless the bias force is overcome by a retraction mechanism 852 (e.g., an arm).

In a particular example, placing the attachment structure 120 on a mounting rail of a mountable bracket 174 of FIG. 1 pushes the movable member 204 to the unlatched position until the attachment structure 120 clears the mounting rail. Once the attachment structure 120 has been placed (e.g., cleared the mounting rail), the biasing member 850 (e.g., a spring) pushes the movable member 204 to the latched position. In a particular aspect, the retraction mechanism 852 (e.g., the arm), in response to a release control signal from the container manager 132 of FIG. 1, rotates (e.g., between 80 and 90 degrees clockwise) to retract the movable member 204 to the unlatched position and locks in place. In response to a latch control signal from the container manager 132, the retraction mechanism 852 unlocks and the biasing member 850 (e.g., a spring) pushes the movable member 204 to the latched position. For example, the container manager 132 sends the release control signal in response to a first user input (e.g., from an authorized user) received via the user interface 112 or the transceiver 136 indicating that the movable member 204 is to be moved to the unlatched position. As another example, the container manager 132 sends the latch control signal in response to a second user input (e.g., from an authorized user or from any user) received via the user interface 112 or the transceiver 136 indicating that the movable member 204 is to be moved to the latched position.

In a particular aspect, the attachment structure 120 includes a retraction control mechanism 854. In a particular implementation, the retraction control mechanism 854, in response to detecting that the static support member 202 is in contact with a surface (e.g., placed on a portion the engagement surface 330 of FIG. 3), moves the movable member 204 from an unlatched position to a latched position. For example, the retraction control mechanism 854 unlocks the retraction mechanism 852 and the biasing member 850 pushes the movable member 204 to the latched position. In response to a release control signal from the container manager 132, the retraction mechanism 852 moves the movable member 204 from the latched position to the unlatched position.

In a particular implementation, the retraction control mechanism 854, in response to detecting that the static support member 202 is in contact with a surface (e.g., placed on a portion of the engagement surface 330 of FIG. 3), activates a locking pin to restrict the movable member 204 from being released or forced open from the latched position. The retraction control mechanism 854 retracts the locking pin in response to a release control signal from the container manager 132. In some examples, the retraction mechanism 852, in response to detecting that the locking pin has been retracted, moves the movable member 204 from the latched position to the unlatched position enabling removal of the attachment structure 120 (and the attached package container 100) from the mounting rail. In some examples, the retraction control mechanism 854 does not automatically move the movable member 204 responsive to detecting that the locking pin has been retracted. In these examples, the movable member 204 can be moved from the latched position to the unlatched position by a user (e.g., applying an external force on the retraction mechanism 852, the movable member 204, or both) while the locking pin is retracted.

The retraction mechanism 852 (e.g., the arm) configured to rotate to retract the movable member 204 by translation from the latched position to the unlatched position is provided as an illustrative example. In some aspects, the retraction mechanism 852 can move in various ways (e.g., rotate, translate, or both), the movable member 204 to move in various ways (e.g., rotate, translate, or both), or both. For example, the retraction mechanism 852 can move in various ways (e.g., rotate, translate, or both) to cause the movable member 204 to move in various ways (e.g., rotate, translate, or both) between the latched position and the unlatched position. In a particular aspect, the retraction mechanism 852, in response to a release control signal from the container manager 132 of FIG. 1, translates from a first position to a second position to cause the movable member 204 to translate from a latched position to an unlatched position. In a particular aspect, the retraction mechanism 852, in response to a release control signal from the container manager 132 of FIG. 1, causes the movable member 204 to rotate from a latched position to an unlatched position. In some examples, the retraction mechanism 852, the movable member 204, or both, can be moved by a user (e.g., applying an external force on the retraction mechanism 852, the movable member 204, or both) while the locking pin is retracted.

Figure 9B:
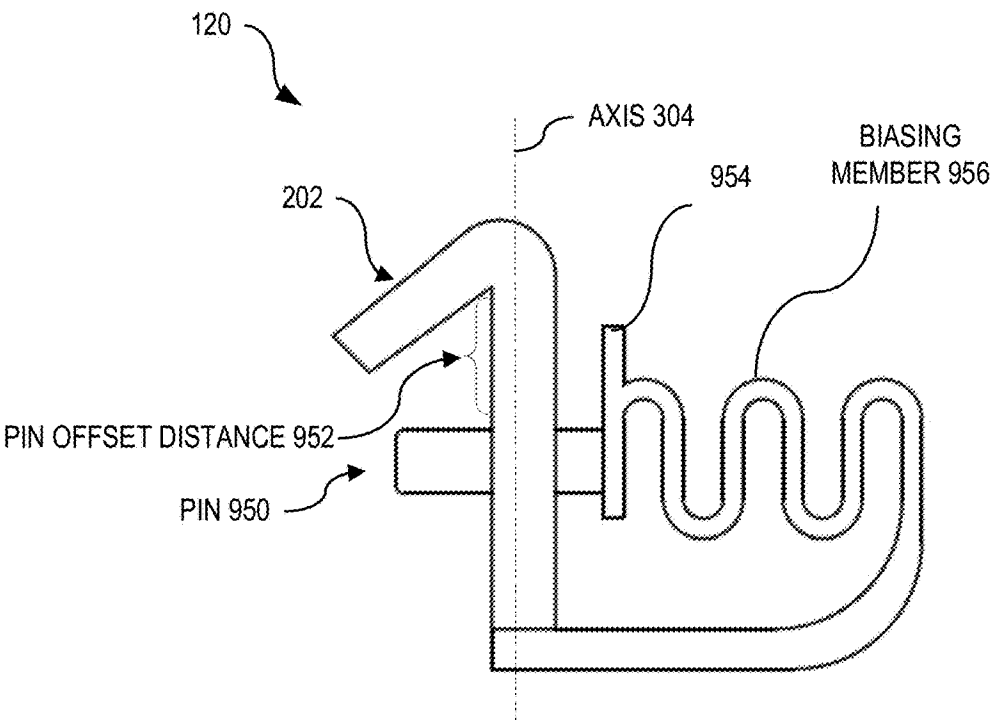
FIG. 9B is another particular view of the attachment structure of FIG. 9A.
Figure 9A:
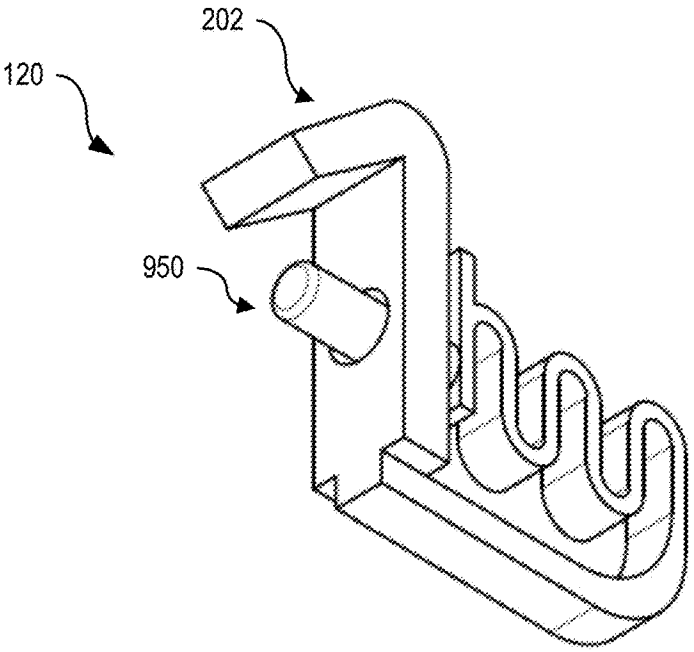
FIG. 9A is a particular view of an example implementation of an attachment structure of FIG. 1.

Referring to FIGS. 9A-9B, particular views of an example implementation of the attachment structure 120 are shown. The attachment structure 120 includes the static support member 202 and a pin 950.

In a particular aspect, the attachment structure 120 is configured to mate with a mountable bracket 174. For example, the attachment structure 120 has a pin offset distance 952 between the static support member 202 and the pin 950. A mountable bracket 174 has a slot offset distance between an engagement surface and a slot portion. The attachment structure 120 is configured to mate with a mountable bracket 174 that has a slot offset distance that matches the pin offset distance 952.

Figure 2B:
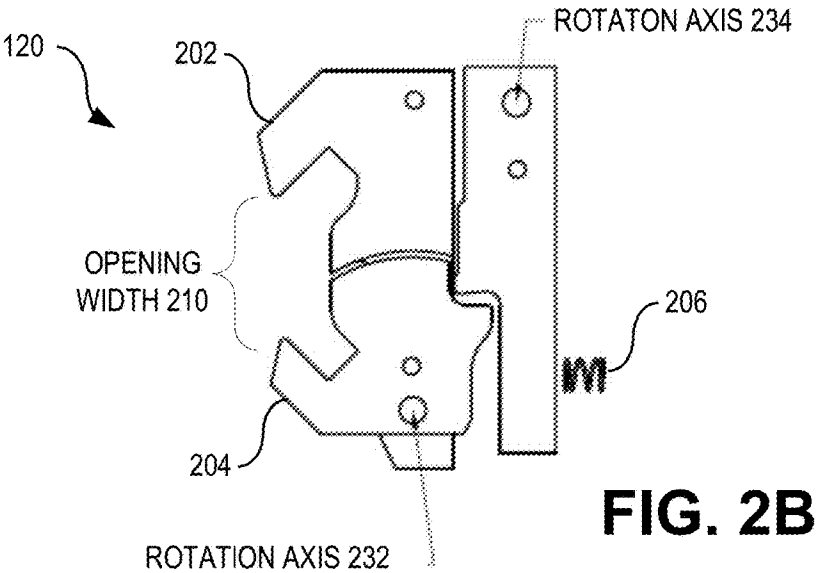
FIG. 2B is another particular view of the attachment structure of FIG. 2A.
Figure 2D:
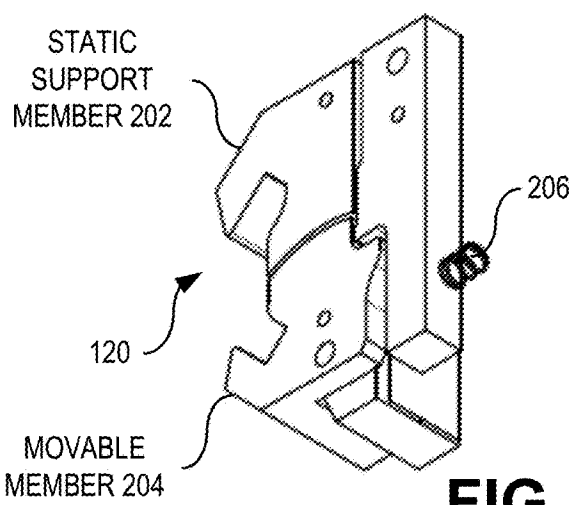
FIG. 2D is another particular view of the attachment structure of FIG. 2A.
Figure 2A:
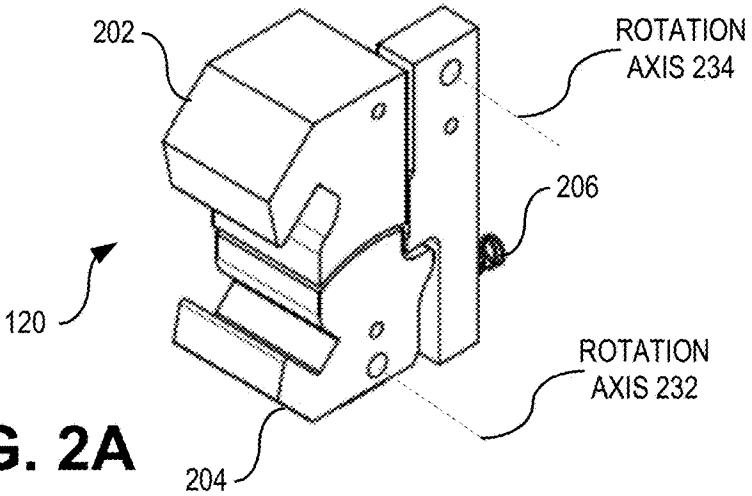
FIG. 2A is a particular view of an example implementation of an attachment structure of FIG. 1.
Figure 2C:
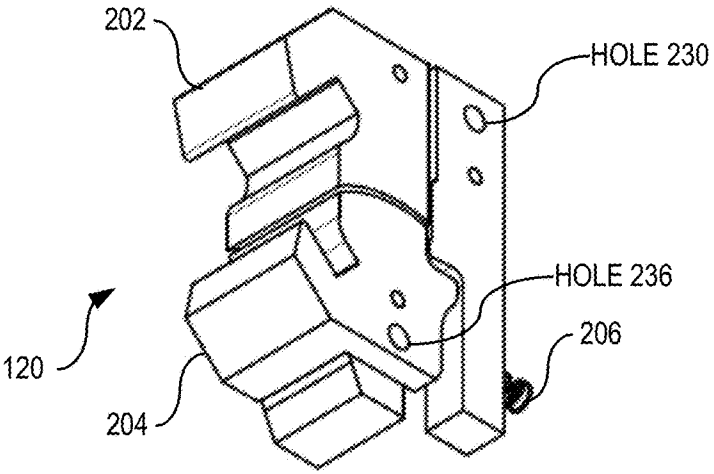
FIG. 2C is another particular view of the attachment structure of FIG. 2A.

In a particular aspect, the attachment structure 120 with the pin 950 has a first width extending along the axis 304 that is less than a second width of an attachment structure 120 with a movable member 204 (e.g., as illustrated in FIG. 2B). The narrower attachment structures 120 (e.g., with the pin 950) can be attached to adjacent rails of a narrower mountable bracket 174 that takes less space on a mounting surface. For example, the mountable bracket 174C of FIG. 7A can have a first mounting rail defined by the engagement surface 330A and the engagement surface 332A, and a second mounting rail defined by the engagement surface 332A. In a particular aspect, the mountable bracket 174C has the slot 662 with a slot width such that a single one of the wider attachment structure 120 (e.g., with the movable member 204) can be attached to the first mounting rail or the second mounting rail at a particular offset along the axis 302. However, a first narrower attachment structure 120 (e.g., with the pin 950) and a second narrower attachment structure 120 (e.g., with the pin 950) can be attached to the first mounting rail and the second mounting, respectively, at the particular offset along the axis 302.

In a particular aspect, the attachment structure 120 with the movable member 204 can support a heavier package container 100 as compared to the attachment structure 120 with the pin 950. In a particular aspect, the pin 950 is attached to a biasing member 956. The biasing member 956 is configured to apply a bias force to keep the pin 950 in an extended position unless the bias force is overcome by a retraction mechanism 954 (e.g., a tab).

Referring to FIG. 10A-10B, particular views of an example of the attachment structure 120 attached to the mountable bracket 174 are shown. The open space of the slot portion 320A defines a trapezoidal shape in a first plane defined by the axis 304 and the axis 306. In other examples, the open space of the slot portion 320A defines other shapes, such as a rectangular shape as illustrated in FIGS. 3A-3B, in the first plane.

The mountable bracket 174 has a slot offset distance 1080 between the engagement surface 330 and the slot portion 320A and has a slot offset distance 1082 between the engagement surface 330 and the slot 362. An attachment structure 120, having a pin offset distance 952 that matches the slot offset distance 1080, is configured to mate with the mountable bracket 174 such that the static support member 202 is supported by at least a portion of the engagement surface 330 and the pin 950 is inserted in the slot portion 320A. Another attachment structure, such as an attachment structure 120A, having a pin offset distance 952A that matches the slot offset distance 1082, is configured to mate with the mountable bracket 174 such that the static support member 202 is supported by at least a portion of the engagement surface 330 and the pin 950 is inserted in the slot 362.

Figure 11B:
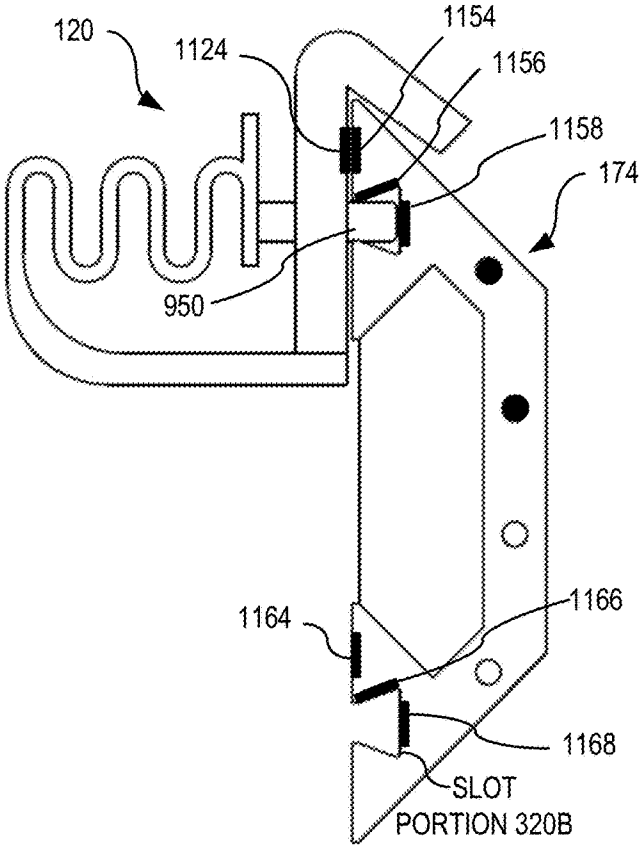
FIG. 11B is another particular view of the mountable bracket of FIG. 11A attached to the attachment structure of FIG. 9.
Figure 11A:
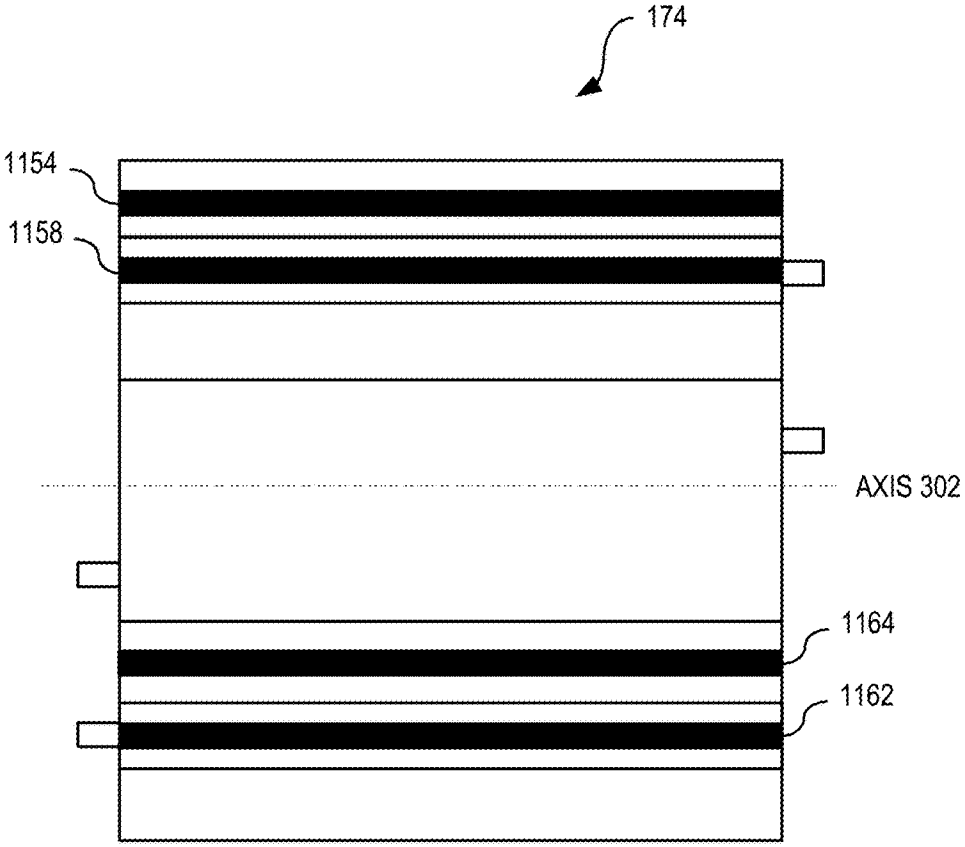
FIG. 11A is a particular view of an example implementation of the mountable bracket of FIG. 1.

Referring to FIGS. 11A-11B, particular views of an example implementation of the mountable bracket 174 are shown. In FIG. 11B, an example of an implementation of the attachment structure 120 attached to the mountable bracket 174 is shown.

The mountable bracket 174 includes interconnects 1154, 1156, 1158, 1164, 1166, 1168, one or more additional interconnects, or a combination thereof. The interconnects 1154-1168, one or more additional interconnects, or a combination thereof, include one or more electrical interconnects, one or more data interconnects, or a combination thereof. In FIG. 11A, each of the interconnects 1154-1168 is illustrated as a linear interconnect that extends along the axis 302. In an alternative implementation, one or more of the interconnects 1154-1168, one or more additional interconnects, or a combination thereof, include spaced interconnects that are spaced apart from each other along the axis 302.

The attachment structure 120 includes an interconnect 1124 (e.g., an electrical interconnect, a data interconnect, or both), one or more additional interconnects, or a combination thereof, that are coupled to a package container 100 (e.g., the container manager 132) that is attached to attachment structure 120. In a particular aspect, a particular interconnect of the mountable bracket 174 is configured to mate with a particular interconnect of the attachment structure 120. For example, the interconnect 1154 of the mountable bracket 174 is configured to mate with the interconnect 1124 of the attachment structure 120.

The attachment structure 120 with the pin 950 is shown as including an interconnect 1124 as an illustrative example. In some examples, an attachment structure 120 with the movable member 204 includes one or more interconnects. In a particular aspect, each of the attachment structure 120 and the mountable bracket 174 can include an interconnect on any surface that comes into contact the other of the attachment structure 120 and the mountable bracket 174. For example, a surface of the pin 950 can include an interconnect that aligns with the interconnect 1158 on the mountable bracket 174. As another example, a surface of the movable member 204 can include an interconnect that aligns with an interconnect on the mountable bracket 174.

In a particular aspect, the interconnect 1154 and the interconnect 1124 enable exchange of power, data, or both, between a package container 100 (e.g., the container manager 132) and another device (e.g., a bracket manager, a user device, another package container 100, or a combination thereof). For example, the interconnect 1154 (e.g., an electrical interconnect) is configured to receive power from a power supply coupled to the mountable bracket 174 and to provide (e.g., via the interconnect 1124) power to a package container 100 while the attachment structure 120 is mated to at least one mounting rail of the mountable bracket 174. In some examples, the interconnect 1154 (e.g., an electrical interconnect) is configured to receive power from a package container 100 while the attachment structure 120 is mated to at least one mounting rail of the mountable bracket 174 and to provide the power (e.g., via the interconnect 1124) to a device (e.g., a battery, another package container, a bracket manager, etc.) coupled to the mountable bracket 174. As another example, the interconnect 1154 (e.g., a data interconnect) is configured to exchange (e.g., via the interconnect 1124) data with a package container 100 while the attachment structure 120 is mated to at least one mounting rail of the mountable bracket 174.

In a particular aspect, the interconnect 1124 of the attachment structure 120 is in contact with the interconnect 1154 at a bracket portion of the mountable bracket 174. An interconnect of a bracket manager is in contact with the interconnect 1154. In a particular aspect, the container manager 132 of the package container 100 receives a bracket portion address of the bracket portion, a bracket address of the mountable bracket 174, or both, via the interconnect 1124 from the interconnect 1154. In some aspects, the container manager 132 outputs container data via the interconnect 1124 to the interconnect 1154. In a particular aspect, the bracket manager receives the container data via the interconnect 1154 from the interconnect 1124. In a particular aspect, the bracket manager also receives a bracket address of the bracket portion via the interconnect 1154. In a particular aspect, the bracket manager provides bracket data via the interconnect 1154 and the interconnect 1124 to the package container 100.

The container data can include a package identifier, a resource request (e.g., a power request, a temperature control request, etc.), order information, recipient information, package condition information (e.g., temperature, weight, movement, etc.), or a combination thereof. The bracket data can include a control signal (e.g., to adjust temperature, power usage, etc.). In a particular aspect, the mountable bracket 174 includes one or more beacons, and the bracket manager can send control signals to the one or more beacons. For example, the mountable bracket 174 includes a bracket beacon, a plurality of bracket portion beacons, or a combination thereof.

In a particular aspect, the bracket manager is configured to perform power management. For example, the bracket manager determines overall power usage of the mountable bracket 174 based on a sum of power usage of the electrical interconnects of the mountable bracket 174. In some implementations, the bracket manager, in response to determining that the overall power usage is above a particular threshold, sends a control signal (e.g., bracket data) to a package container 100 to reduce power consumption. For example, the container data includes a container temperature request indicating that the package container 100 is to maintain a temperature between −5 degrees Fahrenheit and 10 degrees Fahrenheit. The container data also includes container condition data indicating that the package container 100 has a temperature of 0 degrees Fahrenheit. The bracket manager, in response to determining that the overall power usage is above the particular threshold and that a condition of the package container 100 indicates that power consumption of the package container 100 can be reduced while satisfying the container temperature request, sends a control signal to the package container 100 to decrease cooling.

In some implementations, the bracket manager, in response to determining that overall power usage of the mountable bracket 174 is greater than a particular threshold, sends a control signal to a bracket beacon of the mountable bracket 174 to indicate that the mountable bracket 174 is unavailable to mount additional package containers. For example, the bracket beacon outputs a light or a data signal indicating that the mountable bracket 174 is unavailable. A delivery person can, in response to determining that the mountable bracket 174 is unavailable, refrain from mounting additional package containers to the mountable bracket 174.

In some implementations, the bracket manager, in response to determining that a difference between a first overall power usage of a mountable bracket 174A and a second overall power usage of a mountable bracket 174B is greater than a threshold, sends a first control signal to a first bracket beacon of the mountable bracket 174A to indicate that the mountable bracket 174A is not available, and a second control signal to a second bracket beacon of the mountable bracket 174B to indicate that the mountable bracket 174B is available.

In a particular aspect, the bracket manager is configured to perform rail space management. For example, the bracket manager, based on a spacing criterion, uses bracket beacons to indicate whether corresponding mountable brackets 174 are available for additional package containers, bracket portion beacons to indicate whether corresponding bracket portions are available for additional package containers, or a combination thereof. In some implementations, the spacing criterion corresponds to relatively evenly spacing out the package containers 100 among bracket portions of one or more mountable brackets 174. In some implementations, the spacing criterion corresponds to fully utilizing a first mountable bracket 174 prior to making a second mountable bracket 174 available for package containers 100. In some implementations, the spacing criterion corresponds to spacing the package containers 100 to relatively evenly distributing weight on brackets portions of one or more mountable brackets 174. In some implementations, the spacing criterion corresponds to assigning, when available, nearby bracket portions to package containers 100 for the same recipient or group of recipients. In some implementations, the spacing criterion corresponds to assigning an authorized bracket portion or an authorized mountable bracket 174 for a package container 100. For example, a bracket portion or a mountable bracket 174 can be authorized for one or more particular recipients or authorized to receive deliveries in general.

In some examples, a device (e.g., a delivery person's device or a package container 100) sends a bracket portion request to the bracket manager. The bracket portion request can indicate a recipient, a recipient address, a weight of the package container 100, a size of the package container 100, resource requests of the package container 100, or a combination thereof. The bracket manager, in response to receiving the bracket portion request and based on the spacing criterion, identifies one or more bracket portions that are available for the package container 100. The bracket manager sends an indication of at least one of the one or more available bracket portions to a device (e.g., the delivery person's device, the package container 100, or both), sends a control signal to a bracket portion beacon of the at least one available bracket portion to indicate that the bracket portion is available, or both.

A user (e.g., a delivery person) attaches the package container 100 to an indicated available bracket portion. In some implementations, the container manager 132 of the package container 100 receives a bracket portion address of the bracket portion, a bracket address of the mountable bracket 174, or both. In a particular aspect, the package container 100 validates that the package container 100 has been delivered to a correct location, an authorized bracket portion, an authorized mountable bracket, or a combination thereof. For example, the container manager 132, in response to determining that the bracket portion address, the bracket address, or both, match a recipient, a recipient address, or both, of the package container 100, determines that the package container 100 has been delivered to the correct location. In some examples, the container manager 132 uses an authentication protocol to determine that the bracket portion, the mountable bracket 174, or both, are authorized. In a particular example, the container manager 132 sends an alert to a user device, a display device, a server, or a combination thereof, in response to determining that the package container 100 has been delivered to an incorrect location, an unauthorized bracket portion, an unauthorized mountable bracket, or a combination thereof. The container manager 132, in response to determining that the package container 100 has been delivered correctly, outputs container data via the interconnect 1124 to the interconnect 1154.

The bracket manager receives the container data via the interconnect 1154 from the interconnect 1124 and receives the bracket portion address via the interconnect 1154. In a particular aspect, the bracket manager is configured to manage communications. For example, the bracket manager, in response to determining that the container data indicates a recipient, sends a notification to the recipient that a package has been received. In some implementations, the container data also indicates a tracking number, a shipper, or both, and the notification indicates that the package associated with the tracking number, the shipper, or both, has been received. In a particular example, the bracket manager sends a notification to the shipper indicating that a package container has been received. In some implementations, the notification indicates the tracking number, the recipient, or both.

In a particular aspect, the bracket manager is configured to validate delivery location. In a particular example, the container data indicates a recipient or a recipient address. The bracket manager, in response to determining that the bracket portion, the mountable bracket 174, or both, match the recipient or recipient address, determines that the package container 100 has been delivered to the correct location. Alternatively, the bracket manager, in response to determining that the bracket portion, the mountable bracket 174, or both, do not match the recipient or recipient address, generates an alert that is sent to a user device (e.g., the delivery person's device), a shipper of the package container 100, a recipient of the package container 100, or a combination thereof.

In some implementations, the bracket manager is included in a package container 100 that can be attached to a mountable bracket 174, and can be replaced by attaching another package container 100 with another bracket manager. In some examples, the bracket manager includes a processor configured to execute instructions to perform operations described herein.

Figures 12A, 12B, 12C, 12D:
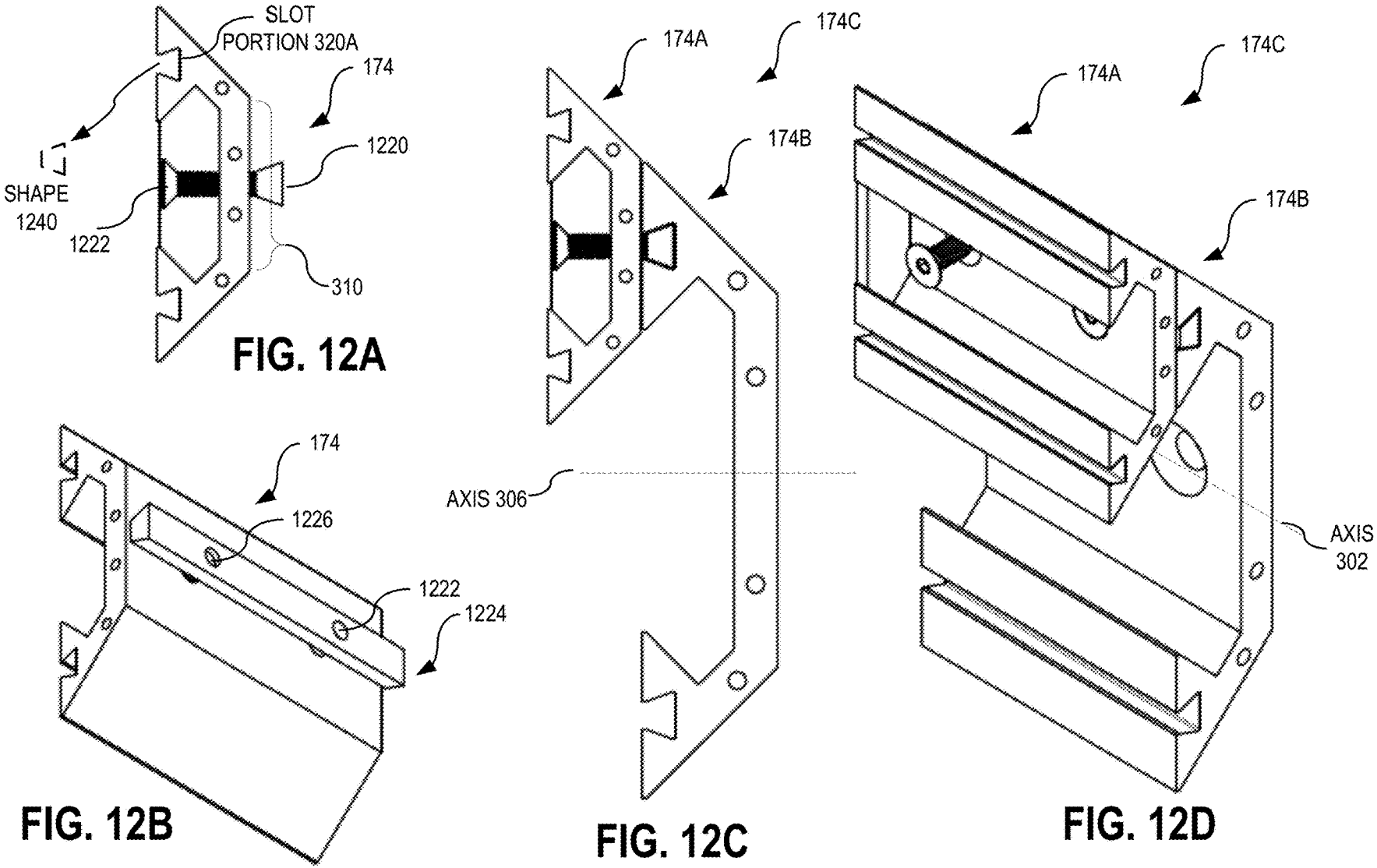
FIG. 12A is a particular view of an example implementation of the mountable bracket of FIG. 1.
FIG. 12B is another particular view of the mountable bracket of FIG. 12A.
FIG. 12C is a particular view of an example of an implementation of the mountable bracket of FIG. 1 attached to another example of an implementation of the mountable bracket of FIG. 1.
FIG. 12D is another particular view of the mountable bracket attached to the other mountable bracket of FIG. 12C.

Referring to FIG. 12A, a particular view of an example implementation of the mountable bracket 174 is shown. The mountable bracket 174 includes a mounting structure 1222 that passes through a hole in the mount member 310 along the axis 306. In a particular aspect, the mounting structure 1222 includes a screw, a bolt, or another fastener. The mounting structure 1222 is configured to mate with a cap 1220. In a particular aspect, the cap 1220 has a shape that is complementary to a shape 1240 of a slot portion 320A of another mountable bracket 174 such that multiple mountable brackets 174 can be attached to each other using the mounting structures 1222 and the caps 1220.

Referring to FIG. 12B, a particular view of an example implementation of the mountable bracket 174 is shown. The mountable bracket 174 is attached to a mounting surface of a bar 1224. In a particular aspect, the bar 1224 has a shape that is complementary to the shape 1240 of the slot portion 320A of the mountable bracket 174 such that the bar 1224 can be inserted in the slot portion 320A of one mountable bracket 174 and can be used to attach to another mountable bracket 174. For example, the bar 1224 includes one or more threaded holes that are aligned with holes in the mount member 310 of the mountable bracket 174. A mountable bracket 174 can be attached to the bar 1224 by passing the mounting structure 1222 through a hole of the mount member 310 to engage with a threaded hole of the bar 1224. In a particular example, the bar 1224 can be attached to a wall, a package container 100, a delivery truck, another mountable bracket 174, etc.

Referring to FIGS. 12C-12D, particular views of an example implementation of the mountable bracket 174 are shown. For example, a mountable bracket 174C is formed by attaching a mountable bracket 174A to a mountable bracket 174B. In a particular example, a slot portion 320A of the mountable bracket 174B includes the cap 1220. The mountable bracket 174A is attached to the mountable bracket 174B by passing the mounting structure 1222 through a hole of the mount member 310 of the mountable bracket 174A to engage with the cap 1220. In another example, the bar 1224 is inserted in the slot portion 320A of the mountable bracket 174B. The mountable bracket 174A is attached to the mountable bracket 174B by passing the mounting structure 1222 through a hole of the mount member 310 of the mountable bracket 174A to engage with a hole 1226 of the bar 1224. In a particular aspect, the mountable bracket 174B is larger than the mountable bracket 174A. The mountable bracket 174A can be used to attach smaller package containers 100 with smaller attachment structures 120. In a particular aspect, a length of the mountable bracket 174A along the axis 302 is less than a length of the mountable bracket 174B. As an illustrative example, a user can attach the mountable bracket 174A to the mountable bracket 174B, attach a package container 100 with a smaller attachment structure 120 to the mountable bracket 174A, and attach a package container 100 with a larger attachment structure 120 to the mountable bracket 174B. The mountable bracket 174B can thus be expanded as needed to accommodate package containers 100 of different sizes.

Figure 13:
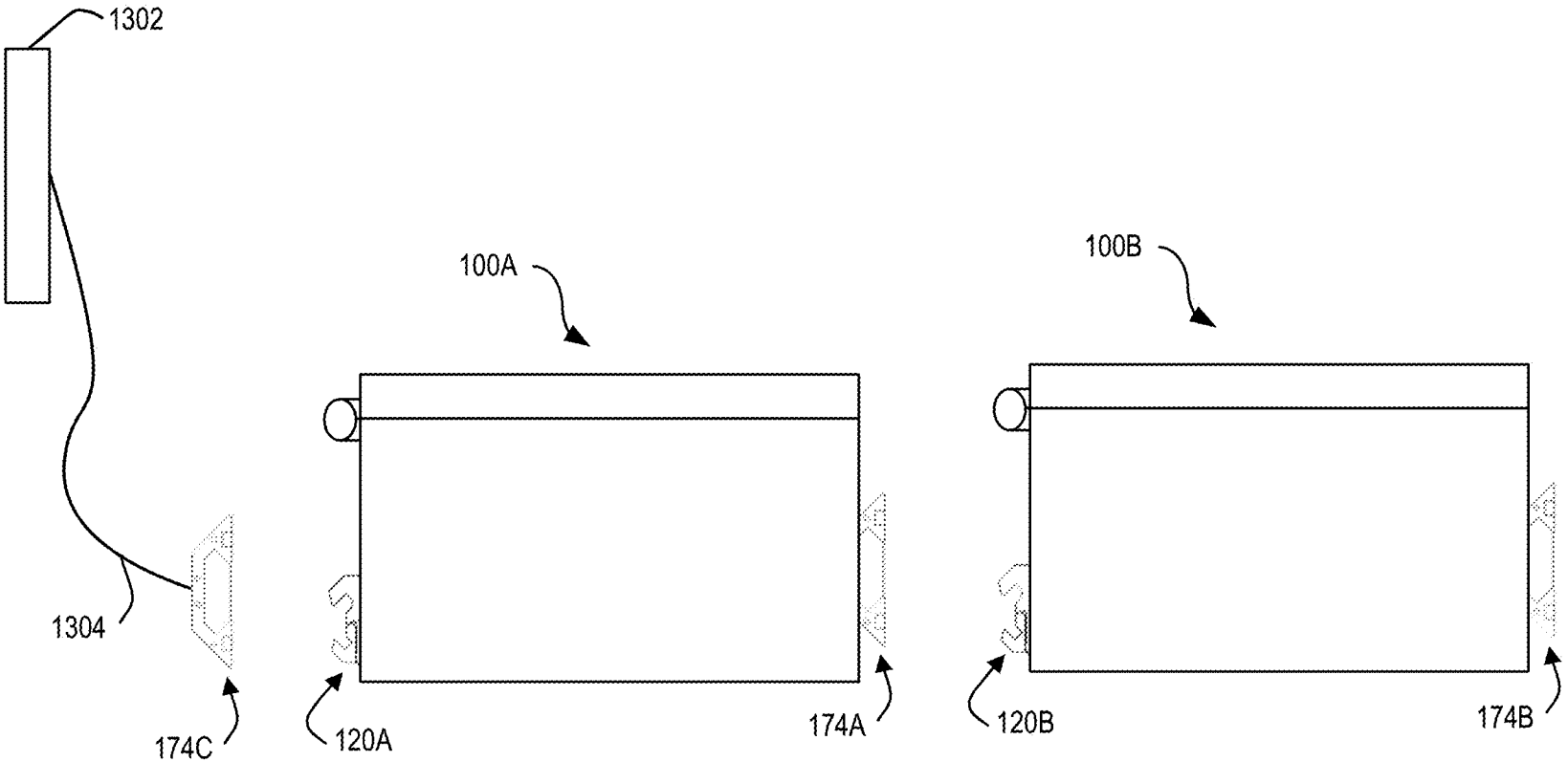
FIG. 13 is an example of multiple package containers of FIG. 1 that can be attached to each other.

Referring to FIG. 13, an example is shown of multiple package containers 100 that can be attached to each other. For example, each of a package container 100A and a package container 100B includes one or more mountable brackets 174, one or more attachment structures 120, or a combination thereof. To illustrate, the package container 100A includes one or more mountable brackets 174A that are configured to mate with one or more attachment structures 120B of a package container 100B.

In a particular aspect, the package container 100B includes one or more mountable brackets 174B that are configured to mate with one or more attachment structures 120A of the package container 100A. The package containers 100A and 100B can thus be attached on either side of each other. In a particular aspect, any count of package containers 100 can be attached on top of each other, next to each other, or a combination thereof, using attachment structures 120 and mountable brackets 174 at various surfaces (e.g., top surfaces, side surfaces, bottom surfaces, or a combination thereof) of the package containers 100.

In a particular aspect, one or more attachment structures 120 of a package container 100 are configured to mate with one or more mountable brackets 174 coupled to a mounting surface of an attachment point 1302. In some examples, a mountable bracket 174C is coupled via a cable 1304 to a mounting surface of the attachment point 1302. In such examples, the cable 1304 allows for movement of the mountable bracket 174C and the package container 100A attached thereto without detaching the package container 100A from the mountable bracket 174C. Additionally or in the alternative, the cable 1304 enables the mountable bracket 174C to be attached to a package container 100A that is too large to mount to the mountable bracket 174C while the mountable bracket 174C is fixedly coupled to the mounting surface. For example, the attachment structure 120A of the package container 100A can be mated to the mountable bracket 174C (that is coupled via the cable 1304 to the mounting surface) while the package container 100A is placed on the floor or at a distance from the mounting surface.

In a particular aspect, each of multiple mountable brackets 174 can be attached via a corresponding cable 1304 to the mounting surface of the attachment point 1302. In a particular aspect, attaching a cable 1304 uses a smaller surface area of the mounting surface of the attachment point 1302 as compared to attaching the mountable bracket 174C directly onto the mounting surface of the attachment point 1302.

In an illustrative example, a plurality of package containers 100 (e.g., corresponding to a single delivery) can be attached to each other and to the attachment point 1302. For example, the package container 100A and the package container 100B can be attached to each other and to the attachment point 1302. To illustrate, the attachment structure 120B can latch onto the mountable bracket 174A, and the attachment structure 120A can latch onto the mountable bracket 174C.

In a particular aspect, various implementations of the attachment structure 120 and the mountable bracket 174 described herein can be combined in a single system. For example, a mountable bracket 174 includes one or more of the middle portions 454, one or two of the end portions 452, or a combination thereof, as described with reference to FIG. 4. The mountable bracket 174 includes one or more of the dividers 564, as described with reference to FIG. 5. The mountable bracket 174 includes a combination of mountable brackets 174, as described with reference to FIGS. 6A-6B and 12C-12D. The mountable bracket 174 can include multiple mounting rails configured to attach to one or more of the attachment structures 102, as described with reference to FIGS. 7A-7B, 10A-10B, and 11B. The mountable bracket 174 can include electrical interconnects, data interconnects, or a combination thereof, that are configured to mate with corresponding electrical interconnects, data interconnects, or a combination thereof, of an attachment structure 120. An attachment structure 120 can include a movable member 204 of FIG. 2, the pin 950 of FIGS. 9A-9B, or both.

Figure 14:
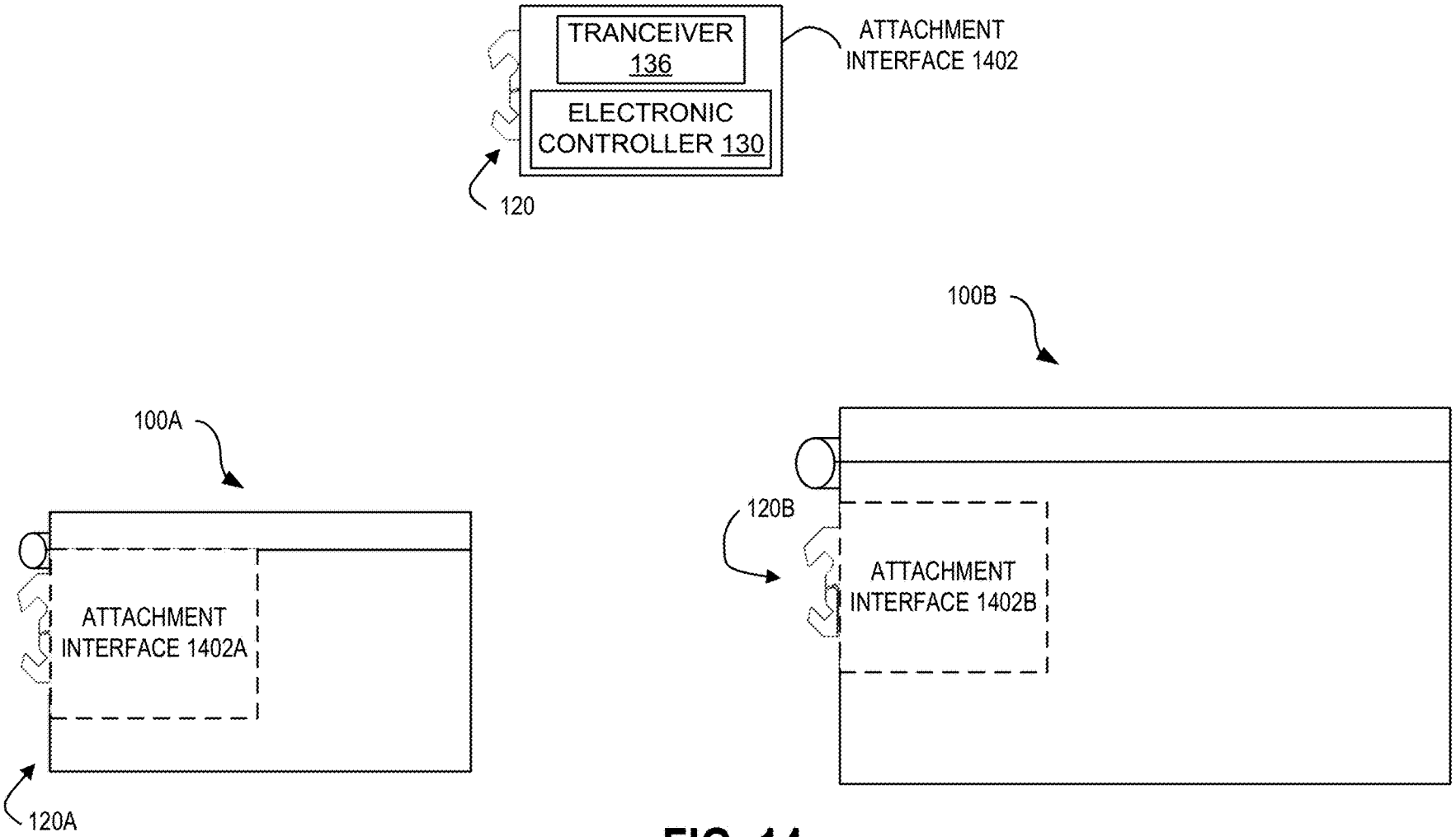
FIG. 14 is an example of an implementation of an attachment interface including an attachment structure of FIG. 1.

Referring to FIG. 14, an example implementation of an attachment interface 1402 is shown. The attachment interface 1402 includes one or more of the attachment structure 120, the electronic controller 130, the transceiver 136, or a combination thereof. In a particular aspect, the electronic controller 130, the transceiver 136, or both, are internal to a housing of the attachment interface 1402. In a particular aspect, at least a portion of the static support member 202 and at least a portion of the movable member 204 of the attachment structure 120 project externally from a surface of the attachment interface 1402. In the illustrated example, the attachment interface 1402 is shown as including the attachment structure 120. In other examples, the attachment interface 1402 can additionally, or alternatively, include one or more of the mountable bracket 174 with at least a portion of one or more mounting rails projecting externally from a surface of the attachment interface 1402.

The attachment interface 1402 can be placed in a package container 100 such that at least a portion of the attachment structure 120 projects externally through an opening of the package container 100, as further described with reference to FIG. 15. For example, a package container 100A includes an attachment interface 1402A with an attachment structure 120A projecting externally through an opening of the package container 100A. A package container 100B includes an attachment interface 1402B with an attachment structure 120B projecting externally through an opening of the package container 100B. In a particular example, the attachment interface 1402A is identical to the attachment interface 1402B, and the package container 100B is larger than the package container 100A. The attachment interface 1402 can thus be added to package containers 100 of various size to enable attachment of the package containers 100 to mounting rails or attachment structures.

Referring to FIG. 15, an example implementation of a support structure 1520 is shown. The support structure 1520 includes the static support member 202 and a static support member 1504.

The support structure 1520 can be used with the attachment structure 120 to provide support to a package container 100 of FIG. 1 when attached to the mountable bracket 174 of FIG. 1. For example, the support structure 1520 and the attachment structure 120 are positioned adjacent to each other extending externally from a surface (e.g., the back 150) of the package container 100. In a particular implementation, the attachment interface 1420 includes the support structure 1520 and the attachment structure 120. When the attachment interface 1420 is placed in the package container 100, at least a portion of the support structure 1520 and at least a portion of the attachment structure 120 extends externally from an opening 1535 of the package container 100.

In a particular aspect, when the package container 100 is placed on a mounting rail of the mountable bracket 174, the static support member 202 of the support structure 1520 is supported by the same engagement surface of the mounting rail (e.g., the engagement surface 330 or the engagement surface 336 of FIG. 3B) that supports the static support member 202 of the attachment structure 120. The support structure 1520 thus enables larger or heavier package containers 100 to be supported by the mountable bracket 174.

Figure 16C:
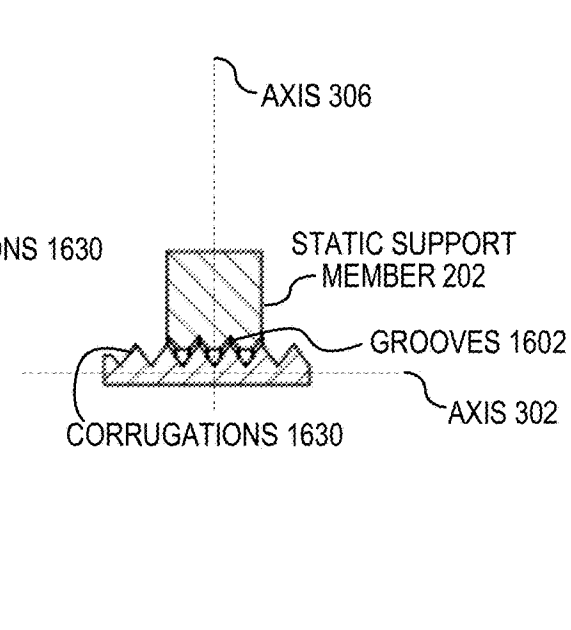
FIG. 16C is another particular view of a portion of the support structure attached to the mountable bracket of FIG. 16A.
Figure 16B:
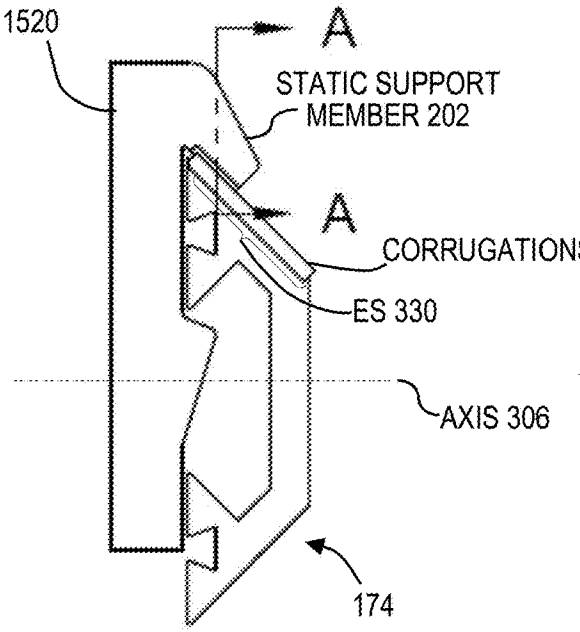
FIG. 16B is another particular view of the support structure attached to the mountable bracket of FIG. 16A.
Figure 16A:
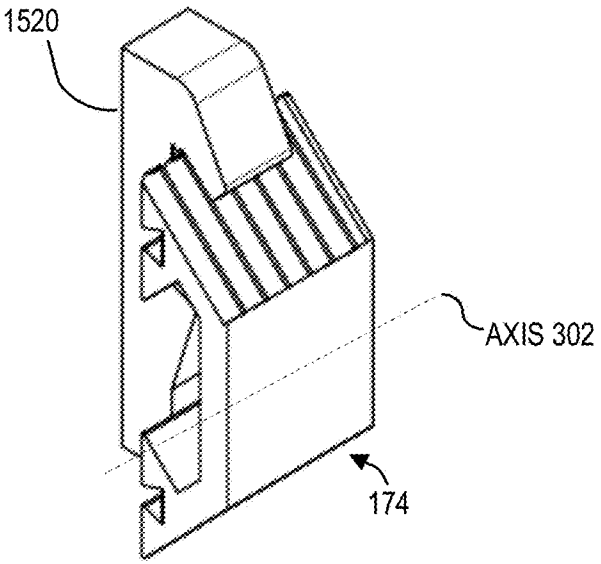
FIG. 16A is a particular view of an example implementation of the support structure of FIG. 15 attached to an example implementation of the mountable bracket of FIG. 1.

Referring to FIGS. 16A-16C, particular views of an example of the support structure 1520 attached to the mountable bracket 174 are shown. The engagement surface 330 of the mountable bracket 174 includes (e.g., is covered with) corrugations 1630. A surface of the static support member 202 of the support structure 1520 includes grooves 1602.

A particular surface of the static support structure 1520 is shown as including the grooves 1602 and a particular surface of the mountable bracket 174 is shown as including the corrugations 1630 as an illustrative example. In other examples, any surface of the static support structure 1520 can include the grooves 1602, the corrugations 1630, or a combination thereof, and any surface of the mountable bracket 174 can include the corrugations 1630, the grooves 1602, or a combination thereof.

In a particular aspect, one or more surfaces of the attachment structure 120 of FIG. 1 include the corrugations 1630, the grooves 1602, or a combination thereof, and one or more surfaces of the mountable bracket 174 include the corrugations 1630, the grooves 1602, or a combination thereof.

The grooves 1602 are configured to engage with the corrugations 1630 to inhibit sliding sideways along the axis 302 of the static support member 202 (e.g., of the attachment structure 120, the support structure 1520, or both) relative to the mountable bracket 174. The grooves 1602 and the corrugations 1630 are provided as an illustrative example. In other examples, one or more surfaces of the mountable bracket 174, the attachment structure 120, the support structure 1520, or a combination thereof, can include various surface features to prevent sliding along the axis 302 of the static support member 202 (e.g., of the attachment structure 120, the support structure 1520, or both) relative to the mountable bracket 174.

In some examples, the grooves 1602 and the corrugations 1630 are aligned for engagement when the package container 100 of FIG. 1 is placed on the mountable bracket 174. In some examples, the package container 100 can be moved sideways along the axis 302 to align the grooves 1602 and the corrugations 1630. Once the grooves 1602 and the corrugations 1630 are aligned, the package container 100 can be moved along the axis 306 to engage with the mountable bracket 174. In a particular aspect, the grooves 1602 and the corrugations 1630 can enable secure attachment of the package container 100 of FIG. 1 to the mountable bracket 174 by inhibiting sliding off of the package container 100 while the attachment structure 120 (e.g., the movable member 204 of FIG. 2) of the package container 100 is latched.

Referring to FIGS. 17A-17D, examples of the mountable bracket 174 attached to a mounting surface of an attachment point 1702 are shown. Multiple mountable brackets 174 can be attached to the mounting surface at particular distances to correspond to particular rail widths. Different rail widths enable engagement with attachment structures 120 with various opening widths.

Figure 17B:
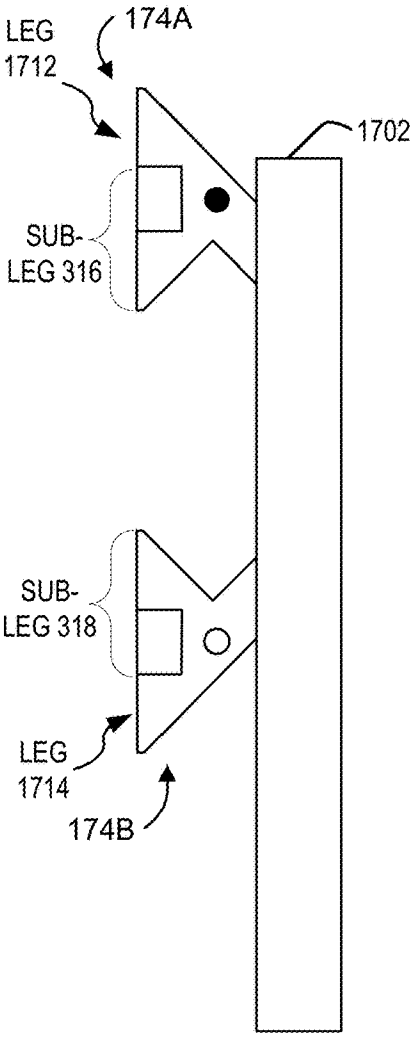
FIG. 17B is a particular view of another implementation of mountable brackets attached to an attachment point.
Figure 17A:
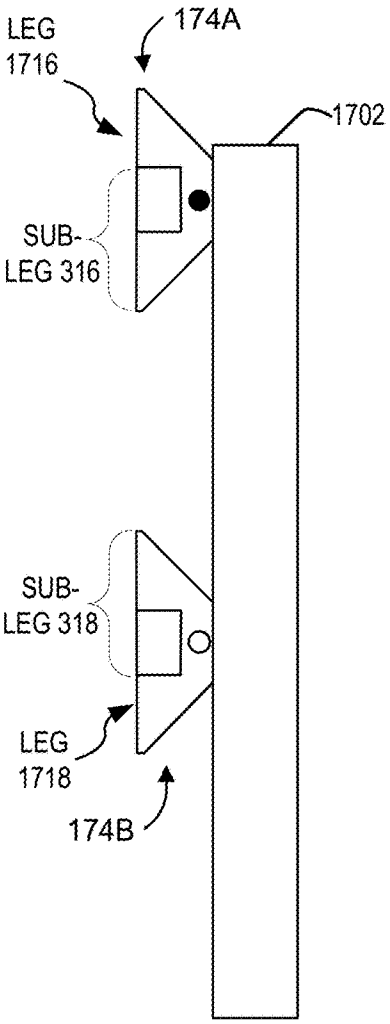
FIG. 17A is a particular view of an implementation of mountable brackets attached to an attachment point.

In FIG. 17A, an example of a pair of mountable brackets, e.g., a mountable bracket 174A and a mountable bracket 174B, is shown. The mountable bracket 174 and the mountable bracket 174B are attached to a mounting surface of an attachment point 1702. The mountable bracket 174A includes a leg 1716 and the sub-leg 316. In a particular aspect, the leg 1716 corresponds to a portion of the leg 312 of the example of the mountable bracket 174 of FIGS. 3A-3C. The mountable bracket 174B includes a leg 1718 and the sub-leg 318. In a particular aspect, the leg 1718 corresponds to a portion of the leg 314 of the example of the mountable bracket 174 of FIGS. 3A-3C.

In FIG. 17B, another example of a pair of mountable brackets, e.g., a mountable bracket 174A and a mountable bracket 174B, is shown. The mountable bracket 174A and the mountable bracket 174B are attached to a mounting surface of an attachment point 1702. The mountable bracket 174A includes a leg 1712 and the sub-leg 316. In a particular aspect, the leg 1712 corresponds to a portion of the leg 312 of the example of the mountable bracket 174 described with reference to FIGS. 3A-3C. The mountable bracket 174B includes a leg 1714 and the sub-leg 318. In a particular aspect, the leg 1714 corresponds to a portion of the leg 314 of the example of the mountable bracket 174 of FIGS. 3A-3C.

Figure 17C:
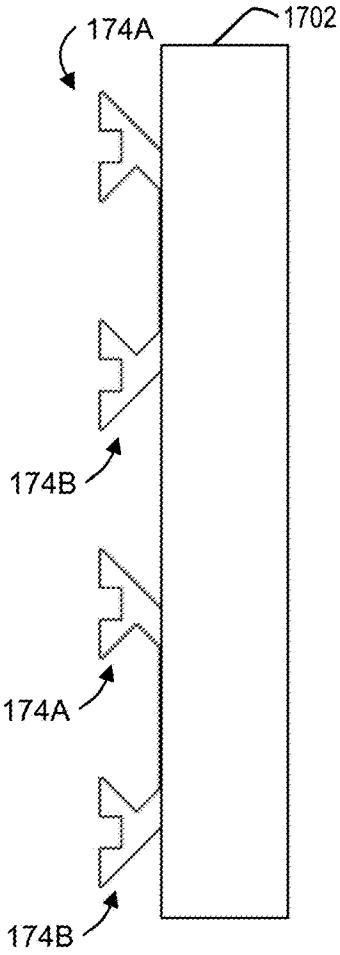
FIG. 17C is a particular view of another implementation of mountable brackets attached to an attachment point.

In FIG. 17C, an example of two pairs of mountable brackets 174 is shown. Each of the pairs corresponds to the mountable bracket 174A and the mountable bracket 174B of FIG. 17B. Both pairs of mountable brackets 174 are attached to a mounting surface of an attachment point 1702.

The mountable bracket 174A of the first pair is mounted at a first distance from the mountable bracket 174B of the first pair, and the mountable bracket 174A of the second pair is mounted at a second distance from the mountable bracket 174B of the second pair. In some aspects, the second distance is the same as the first distance. In other aspects, the second distance is greater than or less than the first distance.

The first pair is mounted at a first alignment on the mounting surface, and the second pair is mounted at a second alignment on the mounting surface. In some examples, the first alignment is the same as the second alignment. In other examples, the first alignment is different from the second alignment.

Figure 17D:
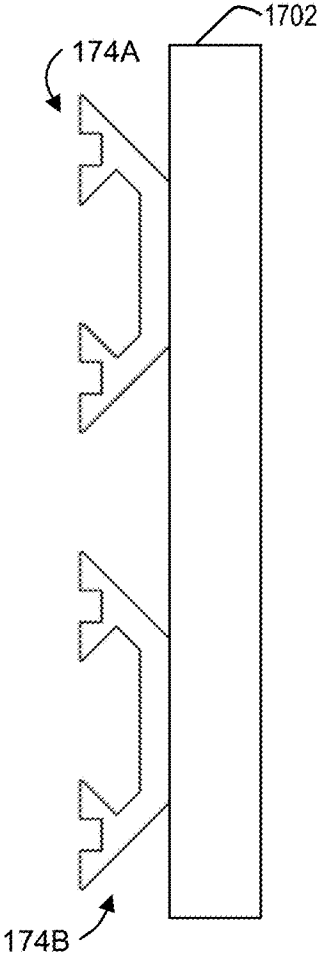
FIG. 17D is a particular view of another implementation of mountable brackets attached to an attachment point.

In FIG. 17D, an example of a pair of mountable brackets 174, e.g., a mountable bracket 174A and a mountable bracket 174B, is shown. Each of the mountable bracket 174A and the mountable bracket 174B corresponds to the mountable bracket 174 of FIGS. 3A-3C.

The mountable bracket 174A and the mountable bracket 174B are attached to a mounting surface of an attachment point 1702. The mountable bracket 174A is mounted at a particular distance from the mountable bracket 174B on the mounting surface.

The mountable brackets 174A and 174B of FIGS. 17A-17C can be attached to a mounting surface without use of the mount member 310 of FIGS. 3A-3C. The mountable brackets 174A and 174B of FIG. 17D can be attached to a mounting surface without use of the mount member 610 of FIGS. 6A-6B, Particular counts of the mountable brackets 174 attached to the mounting surface of the attachment point 1702 at particular alignments are shown for ease of illustration. In other examples, one or more mountable brackets 174 can be mounted at various locations and in various alignments on one or more mounting surfaces of the attachment point 1702.

Figure 18:
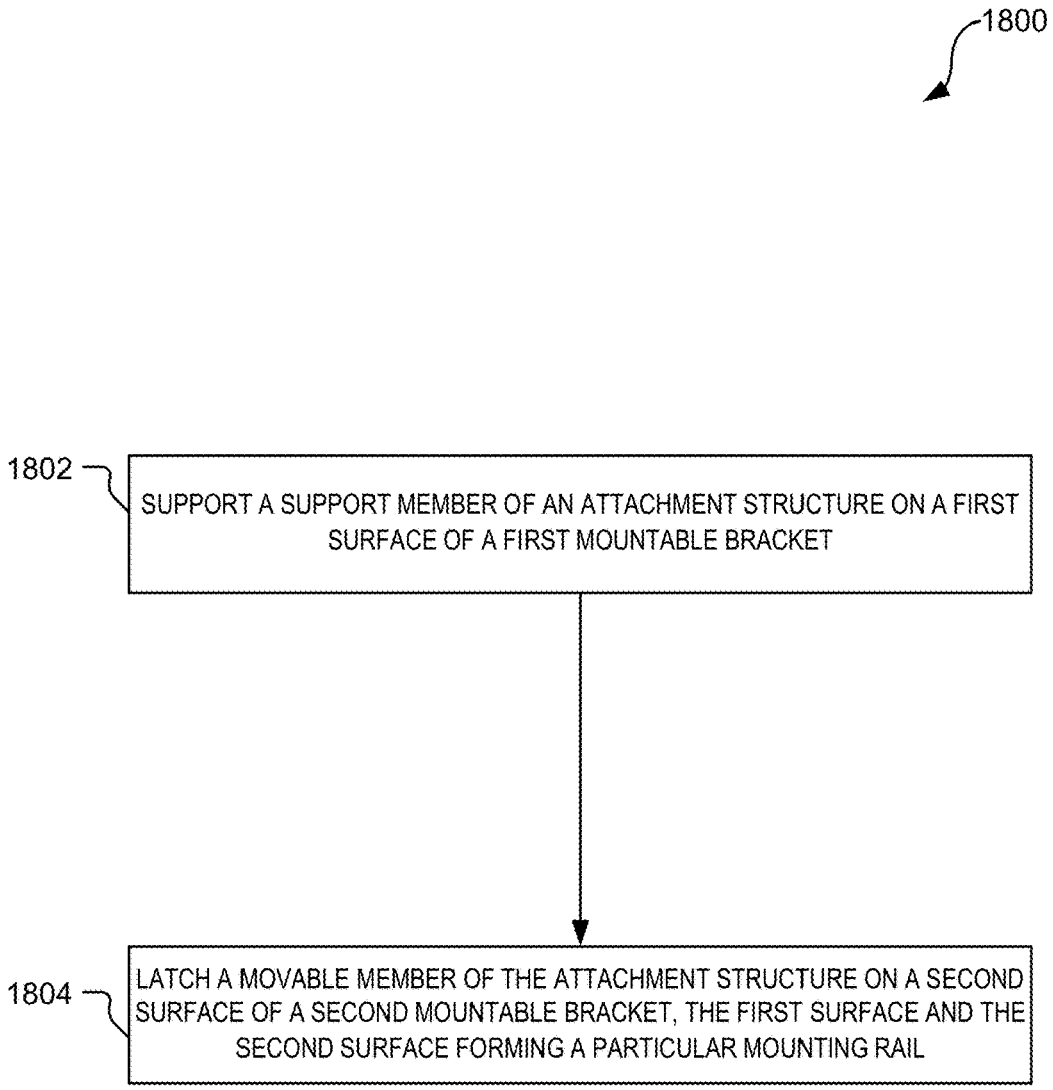
FIG. 18 is a flowchart of a method of using the mountable bracket of FIG. 1 to support an attachment structure of FIG. 1, in accordance with some aspects.

FIG. 18 includes a flow chart of an illustrative method, generally designated 1800, of using a mountable bracket to support an attachment structure. In a particular aspect, the mountable bracket 174 of FIG. 1 is used to support an attachment structure 120 of FIG. 1.

The method 1800 includes supporting a support member of an attachment structure on a first surface of a first mountable bracket, at 1802. For example, as described with reference to FIGS. 3A-3C, at least a portion of the engagement surface 330 of the mountable bracket 174 supports the static support member 202 of the attachment structure 120. The mountable bracket 174 includes a mount member 310 configured to be attached to a mounting surface. The mount member 310 has a length that extends along the axis 302, a width that extends along the axis 304, and a thickness that extends along the axis 306, where the axis 302, the axis 304, and the axis 306 are mutually orthogonal. As another example, as described with reference to FIGS. 7A-7B, at least a portion of the engagement surface 330A of the mountable bracket 174C supports the static support member 202 of the attachment structure 120. The mountable bracket 174C includes a mount member 610 configured to be attached to a mounting surface. The mount member 610 has a length that extends along the axis 302, a width that extends along the axis 304, and a thickness that extends along the axis 306, where the axis 302, the axis 304, and the axis 306 are mutually orthogonal.

The method 1800 also includes latching a movable member of the attachment structure on a second surface of a second mountable bracket, at 1804. For example, as described with reference to FIGS. 3A-3C, the movable member 204 of the attachment structure 120 latches on the engagement surface 334 of the mountable bracket 174. The engagement surface 330 and the engagement surface 334 form a particular mounting rail. As another example, as described with reference to FIGS. 7A-7B, the movable member 204 of the attachment structure 120 latches on the engagement surface 332A of the mountable bracket 174C. The engagement surface 330A and the engagement surface 332A form a particular mounting rail. In a particular aspect, the movable member 204 latches on a surface (e.g., the engagement surface 334 or the engagement surface 332A) of the mountable bracket 174 in response to a latch control signal from the container manager 132, as described with reference to FIGS. 8A-8C. In some examples, the first mountable bracket is the same as the second mountable bracket. To illustrate, the first mountable bracket and the second mountable refer to a single mountable bracket. In other examples, the first mountable bracket is different from the second mountable bracket. To illustrate, the first mountable bracket and the second mountable bracket refer to two distinct mountable brackets.

In a particular aspect, the method 1800 includes unlatching the movable member of the attachment structure. For example, the movable member 204 unlatches in response to a release control signal from the container manager 132, as described with reference to FIGS. 8A-8C.

The method 1800 thus enables latching an attachment structure 120 on a mounting rail of a mountable bracket 174. For example, a package container 100 that includes the attachment structure 120 can be securely attached to the mounting rail of the mountable bracket 174.

Figure 19:
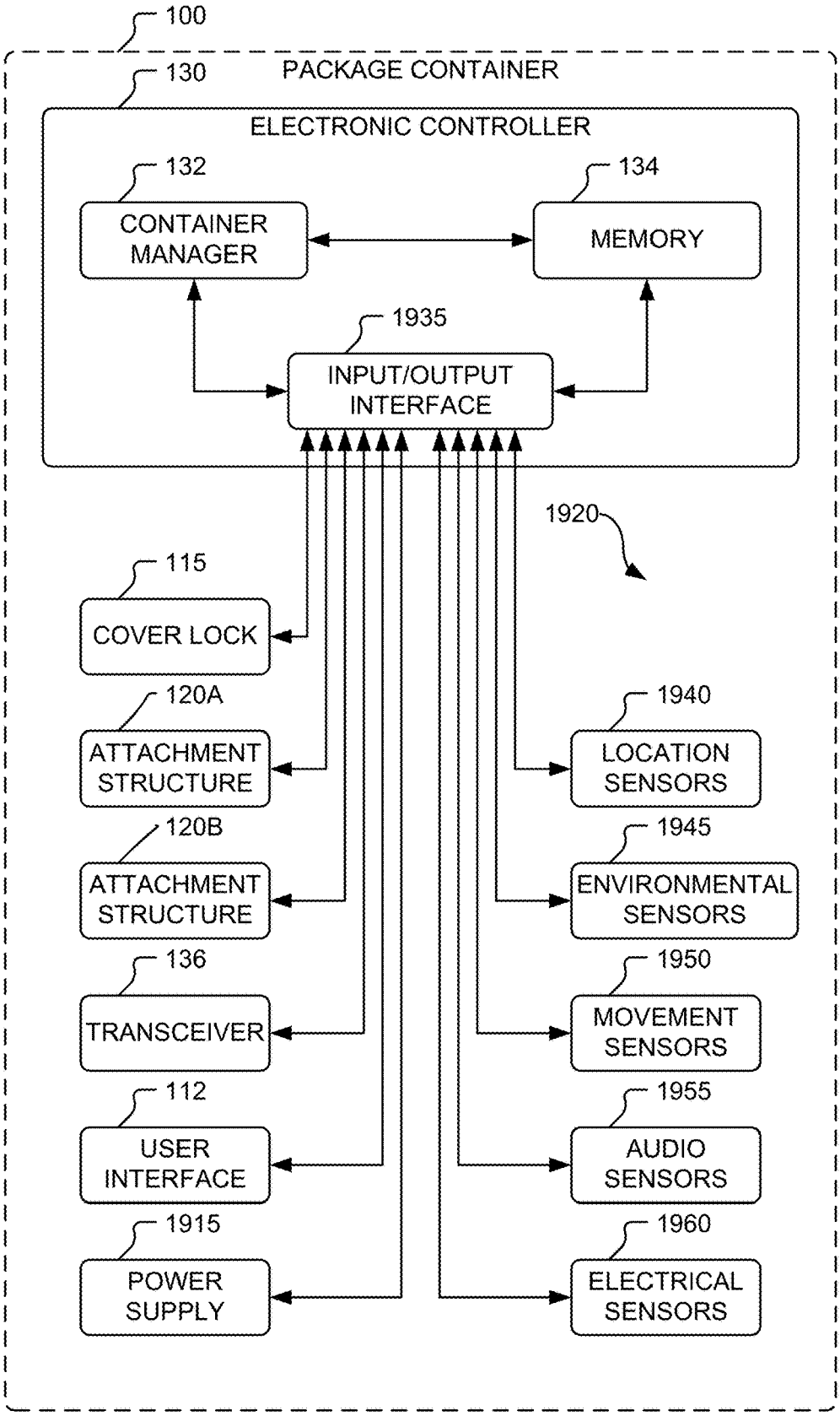
FIG. 19 is a diagram of an example of a computer system configured to implement aspects of systems and methods according to certain aspects of this disclosure.

FIG. 19 is a diagram of one exemplary example of the components included in the package container 100. In the example illustrated, the package container 100 includes the cover lock 115, the attachment structure 120A, the attachment structure 120B, the electronic controller 130, a transceiver 136, the user interface 112, a power supply module 1915, and a plurality of sensors 1920.

The electronic controller 130 includes, among other things, the container manager 132 (e.g., an electronic processor, such as a microprocessor), the memory 134, an input/output interface 1935, and a bus. The bus connects various components of the electronic controller 130 including the memory 134 to the container manager 132. The memory 134 includes read only memory (ROM), random access memory (RAM), an electrically erasable programmable read-only memory (EEPROM), other non-transitory computer-readable media, or any combination thereof. The container manager 132 is configured to retrieve program instructions and data from the memory 134 and execute, among other things, instructions to perform the methods described herein. Additionally or alternatively, the memory 134 is included in the container manager 132. The input/output interface 1935 includes routines for transferring information between components within the electronic controller 130 and other components of internal and external to the package container 100.

The transceiver 136 is configured to provide communications between the package container 100 and a user device, a delivery management server, a bracket manager, an attachment structure, other package container, a courier transportation resource (e.g., a robot or a vehicle), or a combination thereof. The transceiver 136 transmits signals to one or more communication networks and receives signals from the communication networks. In some examples, signals include, for example, data, data packets, control signals, or any combination thereof. In some examples, the transceiver 136 includes separate transmitters and receivers. The communication network may be implemented using various networks, for example, a cellular network, the Internet, a Bluetooth™ network, a wireless local area network (for example, Wi-Fi), a wireless accessory Personal Area Networks (PAN), a low power wide area network (LoRaWAN™, a registered trademark of Semtech Corp., Camarillo, Calif.), cable, an Ethernet network, satellite, low power sensor-to-satellite (LP-S2S), a low orbit satellite network, a machine-to-machine (M2M) autonomous network, a ground positioning system, a global positioning system (GPS), a global navigation satellite system (GNSS), a public switched telephone network, or a combination thereof.

The user interface 112 can include any combination of digital and analog input or output devices required to achieve a desired level of control for the package container 100. For example, the user interface 112 can include a display, a still camera, a video camera, an image sensor, a speaker, a microphone, a fingerprint sensor, a plurality of knobs, dials, switches, buttons, and the like. To illustrate, the speaker can be used to generate audible output (e.g., speech, tone, or both). The microphone can be used to receive audible input (e.g., speech). In some examples, the user interface 112 includes a touch-sensitive interface (for example, touch-screen display) that displays visual output generated by software applications executed by the container manager 132. Visual output includes, for example, graphical indicators, lights, colors, text, images, graphical user interfaces (GUIs), combinations of the foregoing, and the like. The touch-sensitive interface includes a suitable display mechanism for displaying the visual output (for example, a light-emitting diode (LED) screen, a liquid crystal display (LCD) screen, and the like). The touch-sensitive interface also receives user input using detected physical contact (for example, detected capacitance or resistance). Based on the user input, the touch-sensitive interface outputs signals to the container manager 132 which indicate positions on the touch-sensitive interface currently being selected by physical contact. In some implementations, the user interface 112 includes a wireless device, a mobile device, or both. In some implementations, the user interface 112 is included in (e.g., physically attached to) the package container 100. In other implementations, the user interface 112 is remote from (e.g., not physically attached to) the package container 100. In a particular aspect, the user interface 112 includes a user device (e.g., a computer, a communication device, a mobile device, a phone, a tablet, a voice enabled device, a digital assistant, or a combination thereof). In a particular example, the user device corresponds to an extension of the user interface 112. The user interface 112 is coupled to the package container 100. As used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. As used herein, "directly coupled" may include two devices that are coupled (e.g., communicatively coupled, electrically coupled, or physically coupled) without intervening components.

The power supply module 1915 supplies a nominal AC or DC voltage to the package container 100. In some examples, the power supply module 1915 is powered by one or more batteries or battery packs including in the package container 100. The power supply module 1915 is also configured to supply lower voltages to operate circuits and components within the package container 100. In some examples, the power supply module 1915 is powered by household power having nominal line voltages between, for example, 100 volts AC and 240 volts AC and frequencies of approximately 50 hertz to 60 hertz. In some examples, the power supply module 1915 is powered by inductive charging, solar charging, or both.

The plurality of sensors 1920 includes various sensors configured to detect various conditions of the package container 100. In some examples, the plurality of sensors 1920 includes location sensors 1940, environmental sensors 1945, movement sensors 1950, audio sensors 1955, electrical sensors 1960, or any combination thereof.

Location sensors 1940 (for example, global positioning system (GPS) sensors) are used to determine an absolute or relative location of the package container 100. As explained above, in some examples, the package container 100 is secured to an anchoring point upon being delivered. In some examples, the electronic controller 130 ensures that the package container 100 has been delivered to the correct anchoring point by comparing the current location of the package container 100 (determined using the location sensors 1940) to a location of a target anchor point. In some examples, the location sensors 1940 determine the location of the package container 100 periodically. Alternatively and in addition, the location sensors 1940 determine the location of the package container 100 in response to receiving a request (for example, via the transceiver 136). For example, the recipient or sender of the package container 100 sends a request signal to the electronic controller 130, via the transceiver 136, requesting a location of the package container 100. In response, the electronic controller 130 determines a current (or last known) location of the package container 100, via the location sensors 1940, and transmits the location to the recipient or sender, via the transceiver 136. In some examples, the electronic controller 130 determines the location of the package container 100 based at least in part on one or more location signals received via the transceiver 136.

Environmental sensors 1945 (for example, temperature sensors, humidity sensors, chemical sensors, and biological sensors) are used to determine the environmental conditions of the package container 100. For example, the environmental sensors 1945 may be placed within the cavity 165 of the package container 100 and configured to determine the temperature and humidity. In some examples, the electronic controller 130 determines whether predetermined environmental conditions exist within the package container. For example, when the package container 100 is transported an item that requires a temperature below a set threshold, the electronic controller 130 continuously determines the temperature within the package container 100, via the environmental sensors 1945, and transmits an alert signal when the temperature rises above the set threshold. In some examples, the environmental sensors 1945 detect conditions external to the package container 100. For example, the electronic controller 130 tracks temperatures external to the package container 100, via the environmental sensors 1945, and transmits the external temperatures. The external temperatures can indicate thermal challenges in maintaining a temperature within the package container 100 within the set threshold due to external conditions (e.g., too high external temperature or too low external temperature).

Movement sensors 1950 (for example, an accelerometer, gyroscope, or a magnetometer) are used to detect movement of the package container 100. The ability to detect movement of the package container 100 provides a plurality of benefits. For example, while a normal level of movement is to be expected while the package container 100 is being transported, an excessive amount of movement (for example, movement caused by the package container 100 being dropped) may indicate mishandling. In some examples, the electronic controller 130 uses the movement sensors 1950 to detect when the amount of movement is above a set threshold and transmits an alert signal to, for example, the sender, the buyer, the intended recipient, the shipping company, or any combination thereof. These alerts signal may be used to determine the cause of damaged packages.

Another benefit of movement sensors 1950 is added security. For example, after being secured to an anchoring point the package container 100 should not be moving until the recipient retrieves the packages. Movement of the package container 100 after being secured to an anchor point and prior to being retrieved by the recipient could indicate a potential theft attempt. Thus, in some examples, the electronic controller 130 detects such improper movement of the package container 100 and transmits an alert signal to, for example, the sender, the buyer, the intended recipient, the shipping company, or any combination thereof.

Audio sensors 1955 (for example, a microphone) are used to record noise present around the package container 100. For example, the audio sensors 1955 can record audio during a potential theft of the package container 100 while it is secured to an anchor point. The recorded audio can later be used to determine the identity of the party attempting to steal the package container 100. In a particular aspect, the user interface 112 includes one or more of the audio sensors 1955.

The electrical sensors 1960 are used to detect movement of the cover 110 between an opened state and a closed state. For example, the container manager 132 can determine that a trial has started in response to detecting, based on input from the electrical sensors 1960, that the cover 110 has moved from the closed state to the opened state for the first time subsequent to arrival at a delivery location. Electrical sensors 1960 are provided as an illustrative example of sensors that can be used to detect movement of the cover 110. In other implementations, various types of sensors can be used to detect movement of the cover 110, such as a magnetic sensor (e.g., a hall effect sensor, a reed relay sensor, or both), an electrical contact sensor, a still camera, a video camera, an image sensor, or another type of sensor.

In a particular aspect, a mountable bracket includes a first leg configured to be coupled to a mounting surface and extended along a first axis. The first leg is configured to project from the mounting surface at a first angle to define a first engagement surface. The first angle is in a first plane defined by a second axis and a third axis and is not parallel to the second axis or the third axis. The first axis, the second axis, and the third axis are mutually orthogonal. The mountable bracket further includes a first sub-leg coupled to the first leg and extended along the first axis. The first sub-leg projects from the first leg at a second angle to define a second engagement surface. The second angle is in the first plane. The second angle and the first angle are congruent angles on opposite sides of a line parallel to the third axis. The second engagement surface and at least a portion of the first engagement surface form a first mounting rail configured to mate with a first attachment structure having a first opening width. The first engagement surface and a third engagement surface of a second leg form a second mounting rail configured to mate with a second attachment structure having a second opening width. The second opening width is greater than the first opening width.

In another particular aspect, a system includes a first leg configured to be coupled to a mounting surface and extended along a first axis. The first leg is configured to project from the mounting surface at a first angle to define a first engagement surface. The first angle is in a first plane defined by a second axis and a third axis and is not parallel to the second axis or the third axis. The first axis, the second axis, and the third axis are mutually orthogonal. The system further includes a first sub-leg coupled to the first leg and extended along the first axis. The first sub-leg projects from the first leg at a second angle to define a second engagement surface. The second angle is in the first plane. The second angle and the first angle are congruent angles on opposite sides of a line parallel to the third axis. The system also includes a second leg configured to be coupled to the mounting surface and extended along the first axis. The second leg is configured to project from the mounting surface at the second angle to define a third engagement surface. The system further includes a second sub-leg coupled to the second leg and extended along the first axis. The second sub-leg projects from the second leg at the first angle relative to the second axis and the third axis to define a fourth engagement surface. The second engagement surface and at least a portion of the first engagement surface form a first mounting rail having a first rail width. The fourth engagement surface and at least a portion of the third engagement surface form a second mounting rail having the first rail width. The first engagement surface and the third engagement surface form a third mounting rail having a second rail width. The second rail width is greater than the first rail width. An attachment structure is configured to mate with at least one of the first mounting rail, the second mounting rail, or the third mounting rail based on an opening width of the attachment structure.

In another particular aspect, a method includes supporting a support member of an attachment structure on a first surface of a first mountable bracket. The method also includes latching a movable member of the attachment structure on a second surface of a second mountable bracket. The first surface and the second surface form a particular mounting rail. The first mountable bracket includes a first leg configured to be coupled to a mounting surface and extended along the first axis. The first leg is configured to project from the mounting surface at a first angle to define a first engagement surface. The first angle is in a first plane defined by a second axis and a third axis and is not parallel to the second axis or the third axis. The first axis, the second axis, and the third axis are mutually orthogonal. The first mountable bracket includes a first sub-leg coupled to the first leg and extended along the first axis. The first sub-leg projects from the first leg at a second angle to define a second engagement surface. The second angle is in the first plane. The second angle and the first angle are congruent angles on opposite sides of a line parallel to the third axis. The second mountable bracket includes a second leg configured to be coupled to the mounting surface and extended along the first axis. The second leg is configured to project from the mounting surface at the second angle to define a third engagement surface. The second mountable bracket includes a second sub-leg coupled to the second leg and extended along the first axis. The second sub-leg projects from the second leg at the first angle relative to the second axis and the third axis to define a fourth engagement surface. The second engagement surface and at least a portion of the first engagement surface form a first mounting rail having a first rail width. The fourth engagement surface and at least a portion of the third engagement surface form a second mounting rail having the first rail width. The first engagement surface and the third engagement surface form a third mounting rail having a second rail width that is greater than the first rail width. The particular mounting rail includes one of the first mounting rail, the second mounting rail, or the third mounting rail.

This disclosure is not limited in its application to the examples provided, the aspects discussed, or to the details of construction and the arrangement of components set forth in the foregoing description or drawings. The disclosure is capable of other implementations and of being practiced or of being carried out in various ways.

What is claimed is:

1. A mountable bracket comprising:

a first leg configured to be coupled to a mounting surface and extended along a first axis, the first leg configured to project from the mounting surface at a first angle to define a first engagement surface, wherein the first angle is in a first plane defined by a second axis and a third axis and is not parallel to the second axis or the third axis, and wherein the first axis, the second axis, and the third axis are mutually orthogonal; and a first sub-leg coupled to the first leg and extended along the first axis, the first sub-leg projecting from the first leg at a second angle to define a second engagement surface, wherein the second angle is in the first plane, and wherein the second angle and the first angle are congruent angles on opposite sides of a line parallel to the third axis, wherein the second engagement surface and at least a portion of the first engagement surface form a first mounting rail configured to mate with a first attachment structure having a first opening width, and wherein the first engagement surface and a third engagement surface of a second leg form a second mounting rail configured to mate with a second attachment structure having a second opening width, the second opening width greater than the first opening width.

2. The mountable bracket of claim 1, wherein the mounting surface includes a second mountable bracket.

3. The mountable bracket of claim 1, wherein the second leg is included in a second mountable bracket.

4. The mountable bracket of claim 1, further comprising:

a mount member configured to be attached to the mounting surface, the mount member having a length that extends along the first axis, a width that extends along the second axis, and a thickness that extends along the third axis;

the first leg coupled to the mount member;

the second leg coupled to the mount member and extended along the first axis, the second leg projecting from the mount member at the second angle to define the third engagement surface; and a second sub-leg coupled to the second leg and extended along the first axis, the second sub-leg projecting from the second leg at the first angle relative to the second axis and the third axis to define a fourth engagement surface, wherein the fourth engagement surface and the third engagement surface form a third mounting rail configured to mate with a third attachment structure having the first opening width.

5. The mountable bracket of claim 4, wherein the mount member is configured to be coupled via a detachable cable to the mounting surface.

6. The mountable bracket of claim 4, further comprising one or more dividers, wherein a first divider extends from a portion of the first sub-leg to a portion of the second sub-leg to define separate bracket portions along the first axis.

7. The mountable bracket of claim 6, wherein the separate bracket portions are individually addressable.

8. The mountable bracket of claim 4, further comprising an end cap extending from an end portion of the first sub-leg to an end portion of the second sub-leg.

9. The mountable bracket of claim 1, wherein a portion of the first leg and the first sub-leg define a first trapezoidal shape in the first plane, wherein the first trapezoidal shape includes a first side that is opposite and parallel to a second side of the first trapezoidal shape, wherein the first side is shorter than the second side, and wherein the first trapezoidal shape includes a slot portion along the second side of the first trapezoidal shape.

10. The mountable bracket of claim 9, wherein the slot portion includes an open space.

11. The mountable bracket of claim 10, wherein the open space of the slot portion defines a rectangular shape in the first plane.

12. The mountable bracket of claim 10, wherein the open space of the slot portion defines a second trapezoidal shape in the first plane.

13. The mountable bracket of claim 1, wherein the first attachment structure includes a latching mechanism that engages the second engagement surface.

14. The mountable bracket of claim 1, wherein the mounting surface includes a first package container and wherein the first attachment structure is attached to a second package container.

15. The mountable bracket of claim 1, wherein one of a package container or an attachment point includes the mounting surface, and wherein the first attachment structure is attached to the other of the package container or the attachment point.

16. A system comprising:

a first leg configured to be coupled to a mounting surface and extended along a first axis, the first leg configured to project from the mounting surface at a first angle to define a first engagement surface, wherein the first angle is in a first plane defined by a second axis and a third axis and is not parallel to the second axis or the third axis, and wherein the first axis, the second axis, and the third axis are mutually orthogonal;

a first sub-leg coupled to the first leg and extended along the first axis, the first sub-leg projecting from the first leg at a second angle to define a second engagement surface, wherein the second angle is in the first plane, and wherein the second angle and the first angle are congruent angles on opposite sides of a line parallel to the third axis;

a second leg configured to be coupled to the mounting surface and extended along the first axis, the second leg configured to project from the mounting surface at the second angle to define a third engagement surface; and a second sub-leg coupled to the second leg and extended along the first axis, the second sub-leg projecting from the second leg at the first angle relative to the second axis and the third axis to define a fourth engagement surface, wherein the second engagement surface and at least a portion of the first engagement surface form a first mounting rail having a first rail width, wherein the fourth engagement surface and at least a portion of the third engagement surface form a second mounting rail having the first rail width, and wherein the first engagement surface and the third engagement surface form a third mounting rail having a second rail width, the second rail width greater than the first rail width, and wherein an attachment structure is configured to mate with at least one of the first mounting rail, the second mounting rail, or the third mounting rail based on an opening width of the attachment structure.

17. The system of claim 16, further comprising a mountable bracket that includes:

a mount member configured to be attached to the mounting surface, the mount member having a length that extends along the first axis, a width that extends along the second axis, and a thickness that extends along the third axis;

the first leg coupled to the mount member; and the second leg coupled to the mount member.

18. The system of claim 16, further comprising:

a first mountable bracket that includes the first leg; and a second mountable bracket that includes the second leg.

19. The system of claim 16, wherein the attachment structure includes:

a static support member; and a movable member configured to move between a latched position and an unlatched position to prevent removal in the latched position.

20. The system of claim 19, wherein the movable member rotates to the latched position when placed on the first mounting rail.

21. The system of claim 16, wherein the attachment structure is configured to mate with the first mounting rail or the second mounting rail based on the opening width matching the first rail width.

22. The system of claim 16, wherein the attachment structure is configured to mate with the third mounting rail based on the opening width matching the second rail width.

23. The system of claim 16, further comprising a controller configured to, in response to receiving a user input, unlatch the attachment structure.

24. The system of claim 16, further comprising an electrical interconnect, wherein the attachment structure is attached to a package container, and wherein the electrical interconnect is configured to exchange power with the package container while the attachment structure is mated to the at least one of the first mounting rail, the second mounting rail, or the third mounting rail.

25. The system of claim 16, further comprising a data interconnect, wherein the attachment structure is attached to a package container, and wherein the data interconnect is configured to exchange data with the package container while the attachment structure is mated to the at least one of the first mounting rail, the second mounting rail, or the third mounting rail.

26. The system of claim 16, wherein a second attachment structure is configured to mate with the at least one of the first mounting rail, the second mounting rail, or the third mounting rail, and wherein a second opening width of the second attachment structure is equal to the opening width of the attachment structure.

27. The system of claim 16, wherein a second attachment structure is configured to mate with the first mounting rail or the second mounting rail, wherein the attachment structure is configured to mate with the third mounting rail, and wherein the opening width of the attachment structure is greater than a second opening width of the second attachment structure.

28. A method comprising:

supporting a support member of an attachment structure on a first surface of a first mountable bracket; and latching a movable member of the attachment structure on a second surface of a second mountable bracket, the first surface and the second surface forming a particular mounting rail, wherein the first mountable bracket includes a first leg configured to be coupled to a mounting surface and extended along a first axis, wherein the first leg is configured to project from the mounting surface at a first angle to define a first engagement surface, wherein the first angle is in a first plane defined by a second axis and a third axis and is not parallel to the second axis or the third axis, wherein the first axis, the second axis, and the third axis are mutually orthogonal, wherein the first mountable bracket includes a first sub-leg coupled to the first leg and extended along the first axis, wherein the first sub-leg projects from the first leg at a second angle to define a second engagement surface, wherein the second angle is in the first plane, wherein the second angle and the first angle are congruent angles on opposite sides of a line parallel to the third axis, wherein the second mountable bracket includes a second leg configured to be coupled to the mounting surface and extended along the first axis, wherein the second leg is configured to project from the mounting surface at the second angle to define a third engagement surface, wherein the second mountable bracket includes a second sub-leg coupled to the second leg and extended along the first axis, wherein the second sub-leg projects from the second leg at the first angle relative to the second axis and the third axis to define a fourth engagement surface, wherein the second engagement surface and at least a portion of the first engagement surface form a first mounting rail having a first rail width, wherein the fourth engagement surface and at least a portion of the third engagement surface form a second mounting rail having the first rail width, wherein the first engagement surface and the third engagement surface form a third mounting rail having a second rail width that is greater than the first rail width, and wherein the particular mounting rail includes the third mounting rail.

29. The method of claim 28, wherein the first mountable bracket is identical to the second mountable bracket.

* * * * *